US010553224B2

(12) United States Patent
Klejsa et al.

(10) Patent No.: US 10,553,224 B2
(45) Date of Patent: Feb. 4, 2020

(54) METHOD AND SYSTEM FOR INTER-CHANNEL CODING

(71) Applicants: Dolby Laboratories Licensing Corporation, San Francisco, CA (US); DOLBY INTERNATIONAL AB, Amsterdam Zuidoost (NL)

(72) Inventors: Janusz Klejsa, Bromma (SE); Roy M. Fejgin, San Francisco, CA (US); Mark S. Vinton, Alameda, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 16/150,112

(22) Filed: Oct. 2, 2018

(65) Prior Publication Data

US 2019/0103119 A1 Apr. 4, 2019

Related U.S. Application Data

(60) Provisional application No. 62/567,326, filed on Oct. 3, 2017.

(30) Foreign Application Priority Data

Oct. 3, 2017 (EP) ..... 17194538

(51) Int. Cl.
*G10L 19/008* (2013.01)
*G10L 19/00* (2013.01)

(52) U.S. Cl.
CPC ..... *G10L 19/008* (2013.01); *G10L 19/0017* (2013.01)

(58) Field of Classification Search
CPC ..... G10L 19/008; G10L 19/0017
See application file for complete search history.

(56) References Cited

U.S. PATENT DOCUMENTS 8,082,050 B2 12/2011 Schmidt
8,446,947 B2 5/2013 Yu
8,509,931 B2 * 8/2013 Lloyd ..... G10L 15/20 700/94

(Continued)

OTHER PUBLICATIONS

Giurcancanu, C. et al., "Adaptive context-based sequential prediction for lossless audio compression", Published in: 9th European Signal Processing Conference (EUSIPCO 1998), Date of Conference: Sep. 8-11, 1998, Date Added to IEEE Xplore: Apr. 23, 2015, Conference Location: Rhodes, Greece, pp. 1-4.

(Continued)

*Primary Examiner* — Mohammad K Islam

(57) ABSTRACT

A method for performing inter-channel encoding of a multi-channel audio signal comprising channel signals for N channels, with N being an integer, with N>1, is described. The method comprises determining a basic graph comprising the N channels as nodes and comprising directed edges between at least some of the N channels. Furthermore, the method comprises determining an inter-channel coding graph from the basic graph, such that the inter-channel coding graph is a directed acyclic graph, and such that a cumulated a cumulated cost of the signals of the nodes of the inter-channel coding graph is reduced.

20 Claims, 12 Drawing Sheets

(56) References Cited

U.S. PATENT DOCUMENTS

Figure 1A:
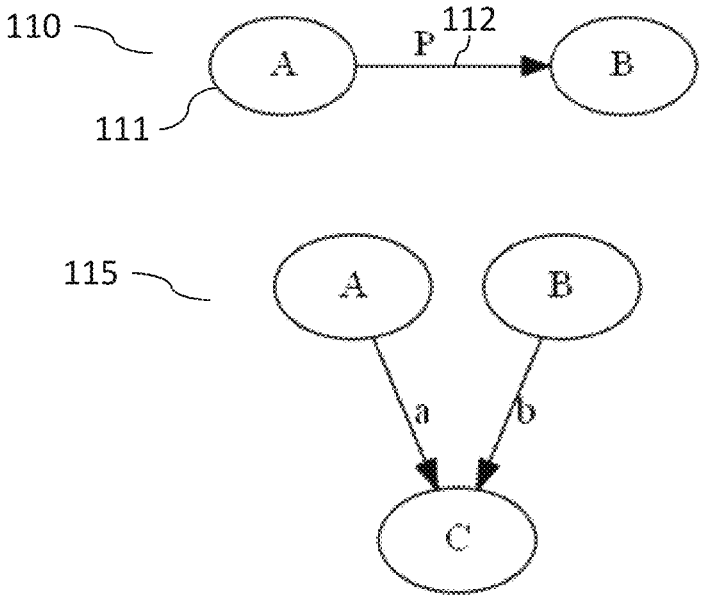

| | | | | |
|---|---|---|---|---|
| 8,983,834 | B2 * | 3/2015 | Davis | G10L 19/008 704/231 |
| 9,417,921 | B2 | 8/2016 | Galdy | |
| 9,426,259 | B2 | 8/2016 | Gower | |
| 2003/0086495 | A1 * | 5/2003 | Cheung | H04N 19/176 375/240.13 |
| 2005/0078832 | A1 * | 4/2005 | Van De Par | G10L 19/08 381/17 |
| 2005/0149322 | A1 * | 7/2005 | Bruhn | G10L 19/008 704/211 |
| 2008/0071548 | A1 | 3/2008 | Moriya | |
| 2008/0262850 | A1 * | 10/2008 | Taleb | G10L 19/008 704/500 |
| 2009/0190693 | A1 | 7/2009 | Moriya | |
| 2010/0014679 | A1 | 1/2010 | Kim | |
| 2010/0027625 | A1 | 2/2010 | Wik | |
| 2011/0032994 | A1 | 2/2011 | Bar-On | |
| 2011/0224994 | A1 | 9/2011 | Norvell | |
| 2012/0035941 | A1 | 2/2012 | Thumpudi | |
| 2012/0093321 | A1 * | 4/2012 | Shim | H04S 1/007 381/22 |
| 2014/0294181 | A1 * | 10/2014 | Kamano | G06F 17/147 381/22 |
| 2015/0281076 | A1 * | 10/2015 | Zhang | H04L 45/64 370/392 |
| 2016/0133266 | A1 * | 5/2016 | Melkote | H04N 19/94 381/23 |
| 2016/0140974 | A1 * | 5/2016 | Valero | G10L 19/028 381/22 |
| 2016/0210720 | A1 | 7/2016 | Taylor | |
| 2016/0247515 | A1 * | 8/2016 | Koishida | G10L 19/167 |
| 2017/0031662 | A1 * | 2/2017 | Bezalel | G06F 8/41 |
| 2018/0025035 | A1 * | 1/2018 | Xia | G06F 16/287 707/600 |
| 2018/0025093 | A1 * | 1/2018 | Xia | G06F 16/9024 707/602 |
| 2019/0005969 | A1 * | 1/2019 | Dick | G10L 19/028 |

OTHER PUBLICATIONS

Kim, J. "Lossless Wideband Audio Compression: Prediction and Transform", 2004, Google Scholar, Diss Berlin Institute of Technology, 2004.

Yu, R., et al. "A fine granular scalable to lossless audio coder", 2006, IEEE Transactions on Audio, Speech, and Language Processing 14.4(2006); pp: 1352-1363.

Kamamoto, Y. et al., "Interchannel dependency analysis of biomedical signals for efficient lossless compression by MPEG-4 ALS", 2008 IEEE International Conference on Acoustics, Speech and Signal Processing, pp. 569-572.

Mastriani, M. "Lossless compression catalyst based on binary allocation via modular arithmetic", 2014, Google Scholar, arXiv preprint arXiv:1405.0933(2014).

Canale, M. et al. "Dataflow programs analysis and optimization using model predictive control techniques: An example of bounded buffer scheduling", 2014, IEEEXplore, 2014 IEEE Workshop on signal processing systems (SiPS) , pp. 1-6.

Sadek, R., "Automatic parallelism for dataflow graphs", 2010, Google Scholar, Audio Engineering Society.

Thornburg, H., "Detection and modeling of transient audio signals with prior information", 2005, Google Scholar, Diss. Stanford University, 2005.

Chu, Y.J, et al "On the Shortest Arborescence of a Directed Graph", Science Sinica 14, 1396-1400.

Edmonds, J. "Optimum Branchings", J. Res. Nat. Bur. Standards 71B, 1967, pp. 233-240.

Tarjan, R.E. "Finding Optimum Branchings" Networks, 1977, 25-35.

Kahn, Arthur B. "Topological Sorting of Large Networks", Communications of the ACM, 5, 558-562, 1962.

* cited by examiner

310

320

METHOD AND SYSTEM FOR INTER-CHANNEL CODING

CROSS-REFERENCE TO RELATED APPLICATIONS

This application claims the benefit of priority from U.S. Patent Application No. 62/567,326 filed Oct. 3, 2017 and European Patent Application No. 17194538.9 filed Oct. 3, 2017, which are hereby incorporated by reference in their entirety.

TECHNICAL FIELD

The present document relates to a method and a system for performing inter-channel coding, notably in the context of lossless audio coding.

BACKGROUND

A channel-based and/or object-based audio codec typically allows for the encoding and the decoding of a multi-channel audio signal which comprises a plurality of channels each comprising a different audio signal. One possibility for increasing the coding gain for encoding a multi-channel signal is to exploit dependencies among channels by means of inter-channel coding. A technical problem addressed is how to provide a computationally efficient scheme for performing inter-channel coding having high coding gain, notably in the context of lossless coding. The scheme improves coding efficiency notably subject to a lossless coding constraint which requires that all the encoder side operations must be invertible on the decoder side in a bit exact manner.

SUMMARY

According to an aspect of the invention, a method for performing inter-channel encoding of a multi-channel audio signal comprising N channels, with N being an integer, with N>1, is described. Each of the channels comprises a channel signal. A channel signal typically comprises a sequence of samples. The samples may be grouped into frames and the channel signals may each comprise a sequence of frames. The method may be performed by an encoder of a system comprising the encoder and a corresponding decoder.

The method comprises determining a basic graph comprising the N channels as nodes and comprising directed edges between at least some of the N channels. Each channel of the multi-channel audio signal may be represented by (exactly) one node. Hence, the basic graph may comprise (exactly) N nodes (plus possibly a (single) dummy node for allowing an independent encoding of at least some of the N channels).

A directed edge from a source channel to a target channel typically indicates that the channel signal of the target channel is predicted from the channel signal of the source channel, thereby leading to a residual signal for the target channel as a prediction residual. The channel signal of a target channel may be predicted from the channel signals of one or more source channels. Each (partial) prediction may be represented by a directed edge. The number of source channels which are used to predict a single target channel may be referred to as the prediction order p. In a particular example, the prediction order may be p=1. Typically, the maximal prediction order is p=N−1. It may be beneficial for an improved tradeoff between coding gain and coding complexity to limit the maximum prediction order to less than N−1.

The basic graph may only comprise first order predictors. Furthermore, the basic graph may comprise cycles comprising more than one node (i.e. cycles other than self-cycles). The basic graph may comprise a plurality of different (first order) predictors for predicting a particular target channel. The method may be directed at identifying the subset of predictors (i.e. the subset of edges) which leads to a reduced cumulated cost and which provides a directed acyclic graph (thereby enabling invertability of inter-channel encoding).

Furthermore, a directed edge may be associated with a cost of the resulting residual signal for the target channel, notably with a cost for encoding the resulting residual signal using an intra-channel encoder. Hence, the basic graph may describe possible prediction relationships between different channels of the multi-channel audio signal. Furthermore, the basic graph may indicate the cost for encoding the different channels of the multi-channel audio signal in a predictive and/or inter-dependent manner.

A graph, notably the basic graph and/or the inter-channel coding graph which is determined within the method, may be represented using a cost matrix and/or a prediction matrix. The different columns of the cost and/or prediction matrix may correspond to different source channels and the different rows of the cost and/or prediction matrix may correspond to different target channels, or vice versa.

The cost matrix may comprise as an entry the cost for coding the residual signal of a target channel which has been predicted from a source channel (as an off-diagonal entry of the cost matrix). Furthermore, the cost matrix may comprise as an entry the cost for coding a channel signal of a target channel independently (as a diagonal entry of the cost matrix). Furthermore, the prediction matrix may comprise as entries one or more prediction parameters for predicting a target channel from a source channel (as off-diagonal entries of the prediction matrix). Hence, a graph may be represented in an efficient manner using a cost matrix and/or a prediction matrix. It should be noted that there are other schemes for representing a graph, e.g. an adjacency list, which could also be applied to the aspects described herein.

The cost associated with coding the residual signal of a target channel (i.e. the prediction cost) and/or the cost associated with coding a channel signal independently (i.e. the direct cost) may depend and/or may be determined based on a variance of the residual signal; based on a number of bits required for encoding the residual signal; and/or based on an inter-channel covariance of the target channels and the source channels. As such, the cost of the one or more directed edges of the basic graph and/or the one or more cost entries of a cost matrix may be determined in an efficient and precise manner (possibly without actually encoding a residual signal and/or a channel signal using an intra-channel encoder).

The method may comprise determining the direct cost for encoding a particular target channel independently. Furthermore, the method may comprise determining the prediction cost for encoding the particular target channel by prediction from at least one particular source channel taken from the remaining N−1 other channels. The direct cost and the prediction cost for encoding the particular target channel may be compared when constructing the basic graph and/or when constructing the cost matrix for the basic graph. The basic graph (and/or the cost matrix) may be determined such that the basic graph does not comprise a directed edge (and/or a matrix entry) from the particular source channel to the particular target channel, if the direct cost is lower than the prediction cost.

Hence, the basic graph (and/or the cost matrix for the basic graph) may be determined such that the basic graph only comprises one or more directed edges from a source channel to a particular target channel, if the (prediction) cost for encoding the residual signal of the particular target channel is lower than the direct cost for encoding the particular target channel independently. In other words, one or more directed edges for predicting a target channel may only be considered within the basic graph, if the prediction cost is lower than the direct cost. By doing this, the basic graph may be simplified and the computational complexity for determining an (optimized) inter-channel coding graph for inter-channel encoding may be reduced without impacting the performance of inter-channel encoding.

The method further comprises determining an inter-channel coding graph from the basic graph. The inter-channel coding graph may then be used by an encoder and/or by a corresponding decoder for performing inter-channel encoding/decoding of the N channels of the multi-channel audio signal.

The inter-channel coding graph may be determined such that the inter-channel coding graph is a directed acyclic graph. In other words, an inter-channel coding graph may be determined which does not comprise any loops or cycles (apart from self-cycles from one node directly to itself). By doing this, it can be ensured that an inter-channel encoded multi-channel audio signal can be decoded (in a lossless manner) by a corresponding decoder from the zero, one or more residual signals and the one or more independently encoded channel signals given the inter-channel coding graph.

Furthermore, the inter-channel coding graph may be determined from the basic graph by selecting edges resulting in a directed acyclic graph such that a cumulated cost of the edges of the inter-channel coding graph is reduced, notably minimized, compared to all possible subsets of edges from the basic graph resulting in a directed acyclic graph. In other words, the inter-channel coding graph may be determined from the basic graph by selecting edges resulting in a directed acyclic graph such that a cumulated cost of the signals of the nodes of the inter-channel coding graph is reduced. The signals of the nodes of the inter-channel coding graph may be the set of inter-channel encoded signals (as described in further detail below).

The signal of a node of the inter-channel coding graph may be a residual signal, if the channel associated with the node is predicted from one or more other channels. On the other hand, the signal of a node of the inter-channel coding graph may be a (original) channel signal, if the channel associated with the node is encoded independently. In other words, the signal of a node of the inter-channel coding graph may be the channel signal of the channel associated with the node, if the inter-channel coding graph indicates that the channel signal of the channel associated with the node is encoded independently. On the other hand, the signal of a node of the inter-channel coding graph may be a residual signal of the target channel associated with the node, if the inter-channel coding graph indicates that the channel signal of the target channel associated with the node is predicted from the channel signals of one or more source channels.

The basic graph may be the superposition of some or all possible first order prediction acyclic graphs. Determining the inter-channel coding graph may comprise selecting an (optimal) subset of edges from the basic graph which leads to a directed acyclic graph and which reduces (e.g. minimizes) the cumulated cost associated with the signals of the nodes of the inter-channel coding graph. The signal of a node may be a residual signal or a (original) channel signal.

The inter-channel coding graph may be determined (from the basic graph) such that the cumulated cost associated with the signal (e.g. either the channel signal or the residual signal) of each of the nodes of the inter-channel coding graph (i.e. associated with a set of inter-channel encoded signals) is reduced (notably minimized). The cumulated cost of the inter-channel coding graph may be reduced compared to a cumulated cost associated with the channel signals of the multi-channel audio signal, notably associated with independent coding of the channel signals of the multi-channel audio signal. Alternatively or in addition, the cumulated cost associated with the signal (e.g. the original channel signal (in case of independent coding) or the residual signal (in case of predictive coding)) of each of the nodes of the inter-channel coding graph (i.e. associated with the set of inter-channel encoded signals of the multi-channel audio signal) may be reduced compared to a cumulated cost associated with the signal (e.g. the original channel signal or the residual signal) of each of the nodes of another acyclic graph derived from the basic graph.

In particular, the inter-channel coding graph may be determined such that the inter-channel coding graph is a directed spanning tree, notably a minimum directed spanning tree, of the basic graph. The inter-channel coding graph may be determined from the basic graph in an efficient manner using Edmonds' algorithm or a derivative thereof. By reducing the overall cost of the directed edges of the inter-channel coding graph, the coding gain for inter-channel encoding may be increased.

Hence, a method for inter-channel encoding of a multi-channel audio signal is described which provides high coding gain at low computational cost, subject to the invertibility constraint. (The inter-channel) coding gain may be determined by comparing the total cost of coding the multi-channel signal when using the inter-channel coding described herein to the total cost of coding obtained for independent coding of the channel signals of the channels of the multi-channel signal.

The graph approach described herein is particularly beneficial to address the inter-channel coding problem subject to a constraint that all the encoder side operations are invertible in a bit exact manner on the decoder side. In particular, formulating the inter-channel coding problem using a graph helps imposing the lossless reconstruction constraint in an efficient manner (by imposing the use of a directed acyclic graph "DAG").

As indicated above, the channel signals of a multi-channel audio signal are typically subdivided into a temporal sequence of frames. Different inter-channel coding graphs may be determined (in a repetitive manner) for at least some of the frames and/or for different groups of frames of the sequence of frames. By doing this, signal adaptive inter-channel coding may be performed.

The basic graph may be determined such that the basic graph comprises a dummy node. In particular, self-cycles of a graph (which indicate an independent coding of the corresponding channel) may be avoided by using a dummy node. The dummy node may e.g. be associated with a virtual audio signal with all samples being zero. A directed edge from the dummy node to a particular target channel (i.e. to the node associated with a particular target channel) may be indicative of an independent encoding of the particular target channel. Furthermore, the cost associated with a directed edge from the dummy node to a particular target channel may correspond to the direct cost for encoding the particular target channel independently. By making use of a dummy node, the self-cycles of a graph may be converted into ordinary edges. In this case, the basic graph using a dummy node can be optimized using graph optimization algorithms to yield a minimum directed spanning tree, which can then be used as the inter-channel coding graph.

The basic graph may be determined such that the basic graph comprises a directed edge from the dummy node to each of the N channels. By doing this, the basic graph takes into account the possibility for independent encoding of each of the N channels. Furthermore, the inter-channel coding graph may be determined such that the dummy node corresponds to a root node of the inter-channel coding graph. The graph optimization may aim at finding the minimum spanning starting from the root node. By doing this, decodability of the inter-channel coding graph may be ensured.

The inter-channel coding graph may be determined such that the inter-channel coding graph is indicative, for each of the N channels, of whether the channel is to be encoded independently or not. Furthermore, the inter-channel coding graph may be indicative, for each of the N channels, from which one or more other channels the channel is to be predicted (if the channel is not encoded independently). Hence, the inter-channel coding graph indicates in a concise manner how inter-channel encoding is to be performed for a particular multi-channel audio signal.

A target channel may be predicted from a source channel using differential coding with possible prediction coefficients being −1 and/or 1; using first order prediction; and/or using multiple order prediction. The one or more prediction parameters may be determined such that the overall cost of the inter-channel coding graph is reduced, notably minimized. The one or more prediction parameters may be included as entries within a prediction matrix describing the basic graph and/or the inter-channel coding graph. Typically, the coding gain of inter-channel encoding may be increased when using higher order prediction. On the other hand, the use of differential coding and/or first order prediction may often provide a reasonable trade-off between coding cost of a graph and the cost of the resulting residual signals.

The method may comprise determining a prediction coefficient for predicting the channel signal of a target channel from the channel signal of a source signal. The prediction coefficient may be determined such that the cost for encoding the residual signal of the target signal is reduced, notably minimized, in accordance to a cost criterion, notably a least-square cost criterion. The prediction coefficient may be included into the inter-channel coding graph. Furthermore, information regarding the prediction coefficient may be signaled within a bitstream to a corresponding decoder. In particular, the method may comprise determining the prediction coefficients for the directed edges of the inter-channel coding graph, and encoding the prediction coefficients into a bitstream.

The method may comprise converting a set of channel signals for the N channels into a set of inter-channel encoded signals using the inter-channel coding graph. In other words, the original N channels may be represented by the inter-channel coding graph and a set of inter-channel encoded signals. By doing this, the set of N channel signals of the multi-channel audio signal is converted into a set of N inter-channel encoded signal. The set of inter-channel encoded signals may comprise at least one (original) channel signal, and zero, one or more residual signals. If inter-channel coding is performed, the set of inter-channel encoded signals comprises one or more residual signals for one or more target channels. Furthermore, a virtual zero channel may be provided for the dummy node. In particular, the set of inter-channel encoded signals may comprise an original channel for those one or more channels, which (according to the inter-channel coding graph) are encoded independently. Furthermore, the set of inter-channel encoded signals may comprise a residual signal for those zero, one or more channels, which (according to the inter-channel coding graph) are encoded using prediction from one or more other (source) channels.

The method may further comprise performing intra-channel encoding for each of the inter-channel encoded signals from the set of N inter-channel encoded signals. The intra-channel encoding may be performed using an intra-channel lossless encoder. The intra-channel encoded signals may then be inserted into a bitstream. Hence, a bitstream which is provided by an encoder may be indicative of the inter-channel coding graph (including the one or more prediction parameters) and of the intra-channel encoded signals. A decoder may be configured to reconstruct the multi-channel audio signal (notably in a lossless manner) using the bitstream.

As indicated above, inter-channel encoding may make use of higher order prediction (with a prediction order p being greater than one). As such, a target channel may be predicted from p source channels. The method may be adapted to determine an inter-channel coding graph for higher order prediction in an efficient manner, thereby providing an increased coding gain (compared to the first order prediction case).

For this purpose, a $p^{th}$ order graph may be determined from the basic graph, wherein the $p^{th}$ order graph makes use of one or more predictors of order p between the channels of the multi-channel audio signal. Hence, the $p^{th}$ order graph may comprise for each channel at maximum p directed edges pointing to this channel. The prediction order p is an integer, with $p \geq 1$.

Furthermore, the method may comprise determining, for a particular target channel which is encoded using a predictor of order p, a predictor of order p+1, such that the predictor of order p+1 leads to a reduced cost for encoding the particular target channel compared to a cost of the predictor of order p. Furthermore, a predictor of order p+1 may be determined which leads to an acyclic inter-channel coding graph. Hence, the prediction order may be increased, and it may be verified whether or not the cost of the inter-channel coding graph is reduced by increasing the prediction order. The prediction order p may be iteratively increased starting from p=1 up to a maximum prediction order. By doing this, a cost-optimized inter-channel coding graph using higher order prediction may be determined in a computationally efficient manner.

Determining a predictor of order p+1 for a target channel may comprise determining a set of p+1 source channels and a set of p+1 prediction coefficients such that a linear combination of the channel signals of the p+1 source channels weighted by the p+1 prediction coefficients approximates the channel signals of the target channel. The predictor of order p+1 for the target channel may be determined by reducing, notably by minimizing, the cost for coding the residual signal of the target channel which is obtained by the prediction of order p+1. Alternatively or in addition, the predictor of order p+1 for the target channel may be determined by reducing, notably by minimizing, an energy of the residual signal.

A predictor of order p+1 may be determined for each target node of the $p^{th}$ order graph, which is encoded using a predictor of order p. Furthermore, a cost benefit achieved by using a predictor of order p+1 for each target node which is encoded using a predictor of order p may be determined. The particular target channels, which is considered for a prediction order p+1, may be selected to be the target channel having the highest cost benefit. In particular, the target channels may be considered sequentially in decreasing order of cost benefit. By doing this, the coding gain of the resulting inter-channel coding graph may be increased.

The method may comprise determining whether the predictor of order p+1 leads to a $p+1^{th}$ order graph comprising zero, one or more cycles. If the $p+1^{th}$ order graph comprises zero cycles, the inter-channel coding graph may be determined directly based on the $p+1^{th}$ order graph.

On the other hand, if the $p+1^{th}$ order graph comprises a single cycle, then the $p+1^{th}$ order graph may be adjusted to remove the single cycle, and the inter-channel coding graph may be determined based on the adjusted graph. Adjusting the $p+1^{th}$ order graph to remove the single cycle may comprise determining a subgraph from the $p+1^{th}$ order graph, wherein the subgraph comprises the single cycle. Furthermore, a (minimum) directed spanning tree may be determined for the subgraph (e.g. using Edmonds' algorithm or a derivative thereof). The subgraph may then be replaced by the directed spanning tree within the $p+1^{th}$ order graph to provide the adjusted graph. By doing this, a single cycle may be removed in an efficient and optimal manner.

However, if the $p+1^{th}$ order graph comprises more than one cycle, the predictor of order p+1 may be replaced by the predictor of order p to determine a fallback graph. In other words, the predictor of order p+1 may not be retained, if more than one cycle is created. The inter-channel coding graph may then be determined based on the fallback graph.

Hence, an inter-channel coding graph using higher order prediction and having relatively high coding gain may be determined using an iterative approach starting from a relatively low prediction order (notably p=1) in an efficient manner.

A sample of the channel signal of the target channel may be predicted from a plurality of samples of the channel signal of the source signal using a corresponding plurality of prediction coefficients. Hence, a set of directed edges adjacent to a single node of a graph may be associated with a plurality of prediction coefficients. By using multiple prediction coefficients, the coding gain for inter-channel coding may be increased.

Inter-channel encoding should be performed such that the resulting set of inter-channel encoded signals is encoded in an efficient manner using an intra-channel encoder. In order to take into account the effect of the intra-channel encoder in the context of inter-channel encoding without actually performing intra-channel encoding, the method may comprise determining pre-flattened channel signals for the channel signals of the N channels, respectively. A pre-flattened channel signal may be determined by applying a linear prediction coding, LPC, filter to the corresponding channel signal. The inter-channel coding graph may then be determined based on the pre-flattened channels (instead of the original channels), thereby implicitly taking into account the effect of subsequent intra-channel encoding in a computationally efficient manner.

In particular, the cost for encoding the residual signal of a target channel predicted from a source channel may be determined based on the pre-flattened channel signals of the target channel and of the source channel. Furthermore, the basic graph and/or the inter-channel coding graph may be determined based on the pre-flattened channel signals. In addition, a prediction coefficient for predicting a target channel from source channels may be determined based on the pre-flattened channel signals of the target channel and of the source channels. On the other hand, the resulting inter-channel coding graph may be applied to the original channel signal of the multi-channel audio signal. By making use of pre-flattened channel signals for the construction of an inter-channel coding graph, the overall coding gain of a combined inter-channel and intra-channel encoder may be increased in a computationally efficient manner.

As indicated above, information regarding the inter-channel coding graph is typically inserted into a bitstream for transmission to a corresponding decoder. The information regarding the inter-channel coding graph may be inserted in such a manner that resources for decoding (notably with regards to storage and computation) may be reduced. For this purpose, the method may comprise sorting the channels of the inter-channel coding graph to provide a topologically sorted graph. The inter-channel coding graph may be sorted such that the channels are assigned to a sequence of positions. In particular, each channel may be assigned to a particular position of the sequence of positions (notably in a one-to-one relationship). Furthermore, the inter-channel coding graph may be sorted such that a channel assigned to a first position from the sequence of positions can be encoded independently. On the other hand, the inter-channel coding graph may be sorted such that for each subsequent position from the sequence of positions, a channel assigned to this position can be encoded independently or can be predicted from the one or more channels assigned to one or more previous positions.

The method may further comprise encoding the topologically sorted graph and/or the multi-channel audio signal (notably the set of inter-channel encoded signals) into a bitstream, such that a decoder is enabled to decode the channels of the multi-channel audio signal in accordance to the positions assigned to the channels. A bitstream syntax of the bitstream may be adapted to indicate an index of a target channel in conjunction with the indexes of the zero, one or more source channels that are used to predict the target channel.

Hence, the inter-channel coding graph may be provided to a decoder in a topologically sorted manner, such that the data for the different channels are received in an order which corresponds to the decoding order imposed by inter-channel encoding. By doing this, storage and processing resources may be reduced at a decoder.

An overall encoding scheme may allow for layered encoding of different presentations, e.g. a main presentation and a dependent presentation. Each presentation may comprise a multi-channel audio signal. The method may be directed at performing inter-channel encoding of a main presentation and of a dependent presentation. The above mentioned multi-channel audio signal, for which an inter-channel coding graph is determined, may correspond to the dependent presentation. The main presentation may comprise one or more (additional) main channels. In other words, the main presentation may comprise a multi-channel signal comprising one or more channels which are referred to herein as one or more main channels.

The method may be configured to exploit inter-dependencies between the main presentation and the dependent presentation. In particular, dependencies of the dependent presentation on the main presentation may be exploited. For this purpose, the basic graph may comprise a main node representing a main channel. In particular, the basic graph may comprise a node for each of the channels of the main presentation. A node which is associated with a main channel of the main presentation may be referred to herein as a main node. Furthermore, the basic graph may comprise one or more directed edges having a main node as a source. On the other hand, the basic graph does not comprise any directed edges having the main node as a target. By doing this, the dependency relationship between the presentations may be imposed throughout the optimization for determining the inter-channel coding graph.

The method may comprise encoding the multi-channel audio signal into a bitstream. In other words, the methods outlined herein may be applied in the context of lossless multi-channel and/or object audio coding.

According to a further aspect, a method for encoding an inter-channel coding graph which is indicative of inter-channel coding of channels of a multi-channel audio signal into a bitstream is described. The aspects described herein are also applicable to this method.

The inter-channel coding graph may comprise nodes that represent the channels of the multi-channel audio signal and directed edges that represent coding dependencies between the channels. The inter-channel coding graph may be used to obtain a set of inter-channel encoded signals, notably residual signals, that jointly with the inter-channel coding graph facilitate reconstruction of the original channel signals. The inter-channel coding graph may have been determined using the methods described herein.

The method comprises sorting the channels (i.e. the nodes) of the inter-channel coding graph to provide a topologically sorted graph. The sorting may be performed such that the channels are assigned to a sequence of positions; such that a channel assigned to a first position from the sequence of positions can be encoded independently; and such that for each subsequent position from the sequence of positions, a channel assigned to this position can be encoded independently or can be encoded in dependence of one or more channels assigned to one or more previous positions.

Furthermore, the method comprises encoding the topologically sorted graph and/or the multi-channel audio signal into a bitstream, notably such that a decoder is enabled to decode the channels of the multi-channel audio signal in accordance to the positions assigned to the channels. Hence, an encoding method is described which enables a resource efficient decoding of a bitstream.

According to a further aspect, a method for performing inter-channel encoding of one or more dependent channels of a dependent presentation in dependence of a main channel of a main presentation is described. The aspects described herein are also applicable to this method.

The method comprises determining a basic graph comprising the one or more dependent channels and the main channel as nodes and comprising directed edges between at least some of the channels. A directed edge between a source channel and a target channel indicates that the channel signal of the target channel is predicted from the channel signal of the source channel, thereby leading to a residual signal for the target channel as a prediction residual. Furthermore, a directed edge indicates a cost associated with coding the residual signal of the target channel.

The basic graph is determined such that the basic graph comprises one or more directed edges having a main channel of the main presentation as a source channel. On the other hand, the basic graph is determined such that the basic graph does not comprise any directed edges having the main channel as a target channel.

The method further comprises determining an inter-channel coding graph for the dependent presentation from the basic graph, such that the inter-channel coding graph is a directed acyclic graph. Hence, the method allows exploiting dependencies between the channels of a dependent presentation and the one or more channels of a main presentation in an efficient manner.

According to a further aspect, an audio encoder comprising a processor is described. The processor may be configured to perform any of the (encoding) methods outlined herein.

According to a further aspect, a bitstream which is indicative of N encoded channels of a multi-channel audio signal and which is indicative of an inter-channel coding graph that has been used to inter-channel encode the N encoded channels is described.

In particular, the bitstream may be indicative of a topologically sorted inter-channel coding graph. The graph may have been sorted, such that the channels of the multi-channel audio signal are assigned to a sequence of positions; such that a channel assigned to a first position from the sequence of positions has been encoded independently;

and such that for each subsequent position from the sequence of positions, a channel assigned to this position has been encoded independently or has been encoded in dependence of one or more channels assigned to one or more previous positions. As a result of this, the bitstream enables a resource efficient decoding of the inter-channel encoded multi-channel audio signal.

According to a further aspect, a method for decoding a bitstream is described. The method may comprise features corresponding to the features of the encoding methods described herein. The bitstream may be indicative of N encoded channels of a multi-channel audio signal and of an inter-channel coding graph that has been used to inter-channel encode the N encoded channels. The method comprises performing intra-channel decoding of the N encoded channels to provide N inter-channel encoded channels. Furthermore, the method comprises performing inter-channel decoding in accordance to the inter-channel coding graph to provide N reconstructed channels of a decoded multi-channel audio signal.

According to a further aspect, an audio decoder comprising a processor configured to perform the methods for decoding described herein is described.

According to a further aspect, a software program is described. The software program may be adapted for execution on a processor and for performing the method steps outlined herein when carried out on the processor.

According to another aspect, a storage medium is described. The storage medium may comprise a software program adapted for execution on a processor and for performing the method steps outlined herein when carried out on the processor.

According to a further aspect, a computer program product is described. The computer program may comprise executable instructions for performing the method steps outlined herein when executed on a computer.

It should be noted that the methods and systems including its preferred embodiments as outlined in the present patent application may be used stand-alone or in combination with the other methods and systems disclosed herein. Furthermore, all aspects of the methods and systems outlined in the present patent application may be arbitrarily combined. In particular, the features of the claims may be combined with one another in an arbitrary manner.

SHORT DESCRIPTION OF THE FIGURES

Figure 2A:
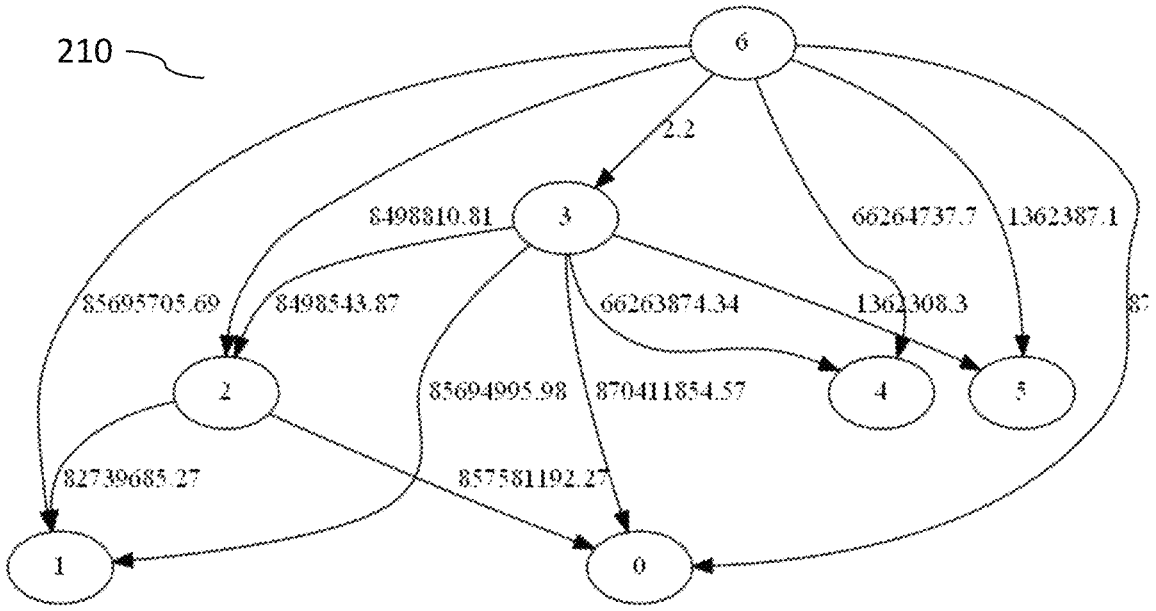
Figure 2B:
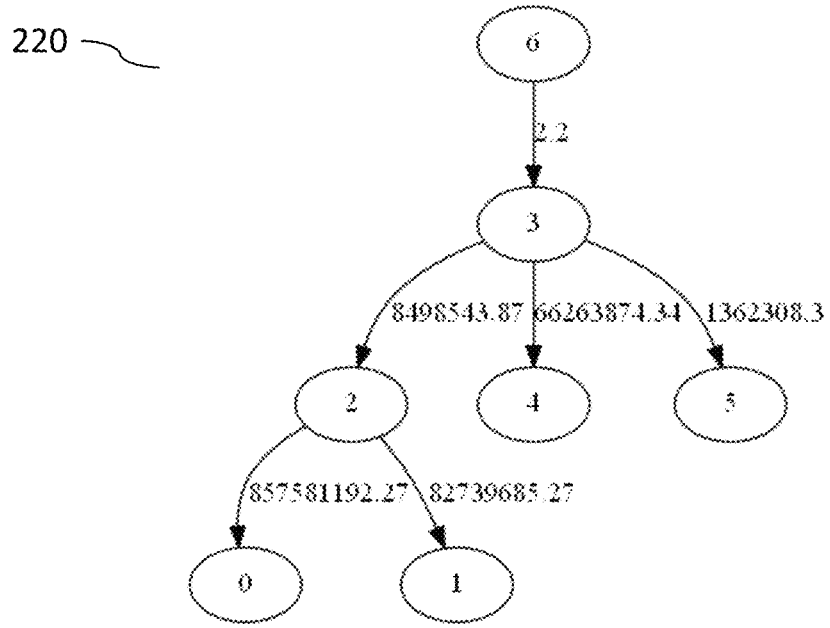
Figure 3A:
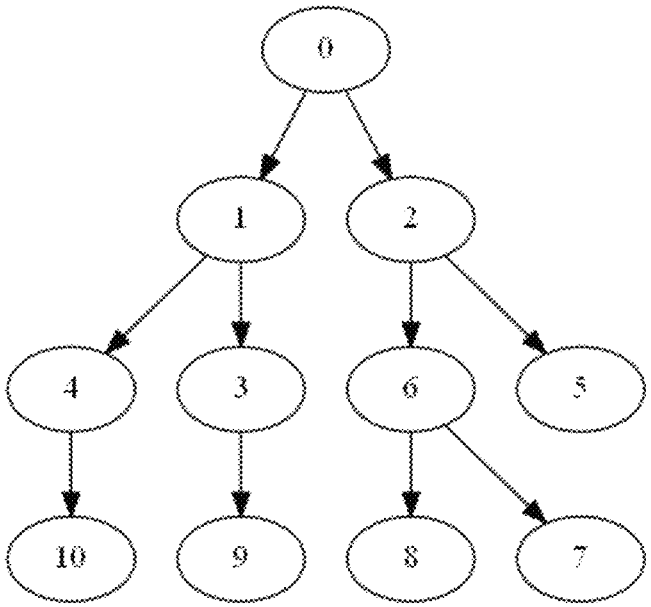
Figure 3B:
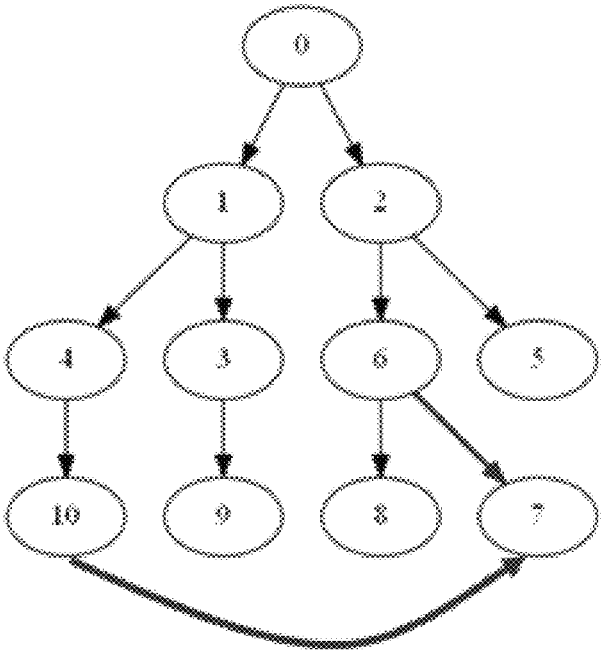
Figure 3C:
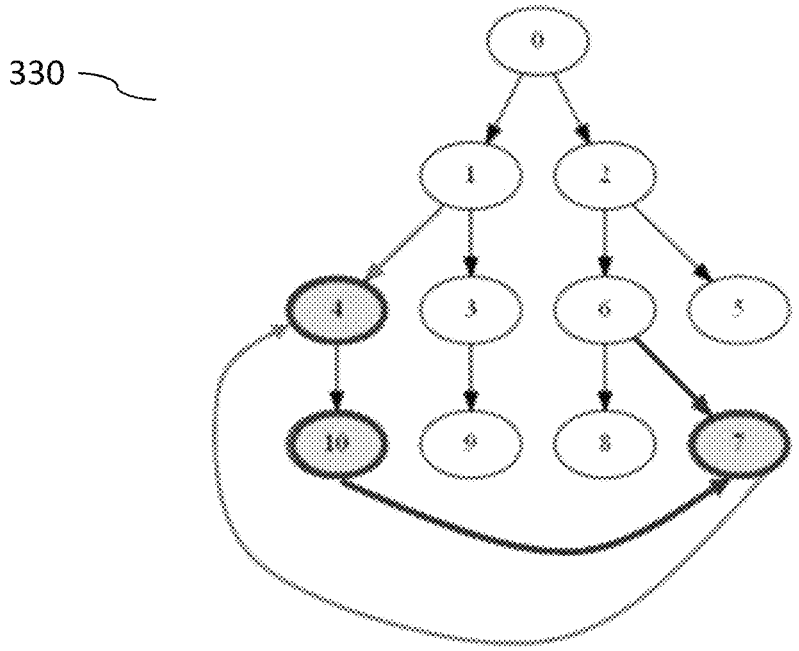
Figure 3D:
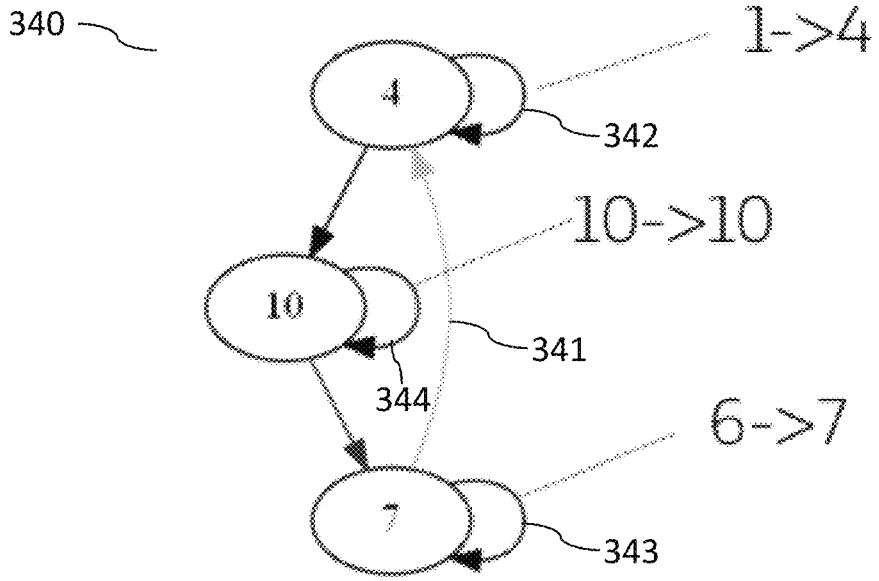
Figure 3E:
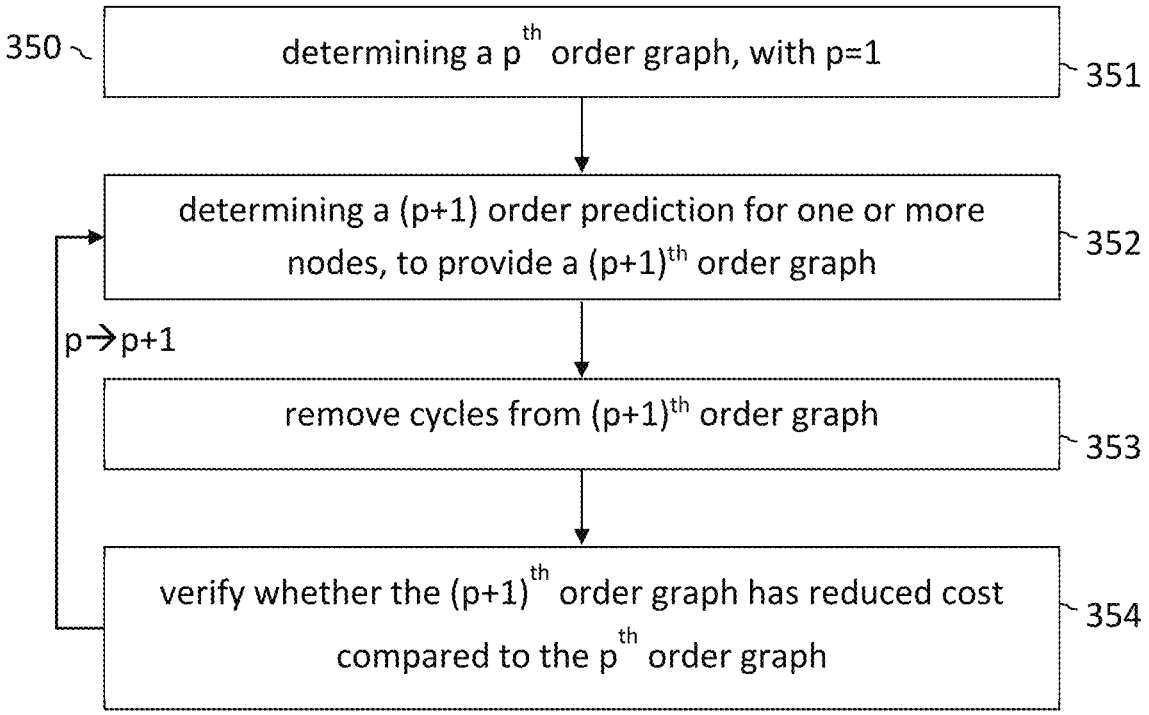
Figure 4A:
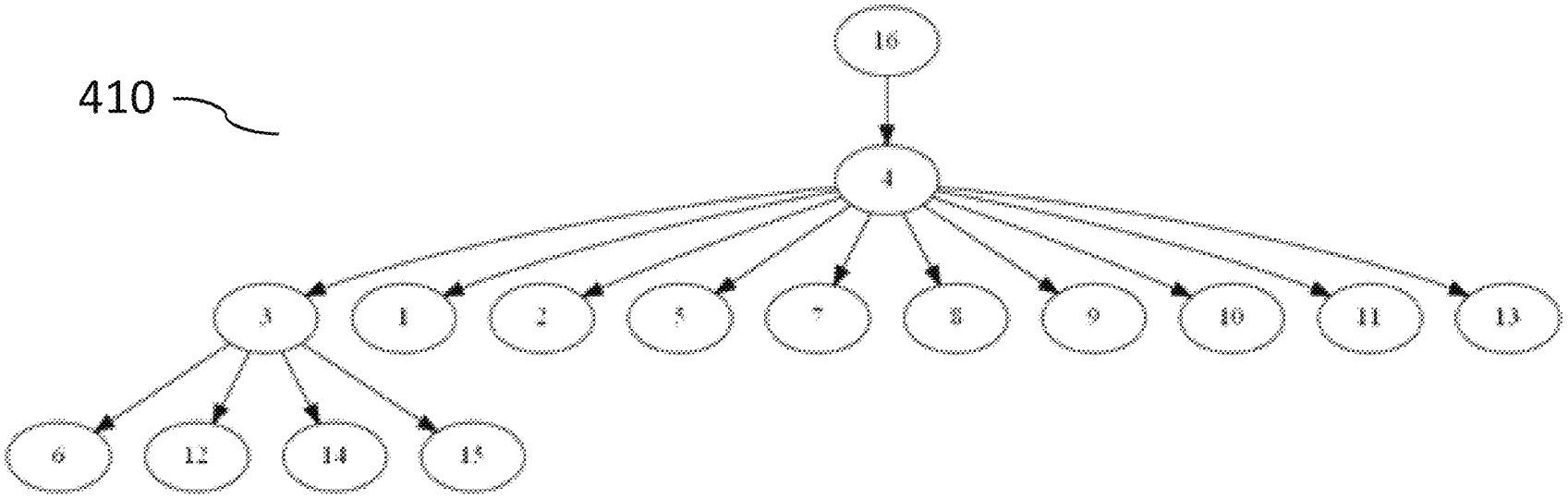
Figure 4B:
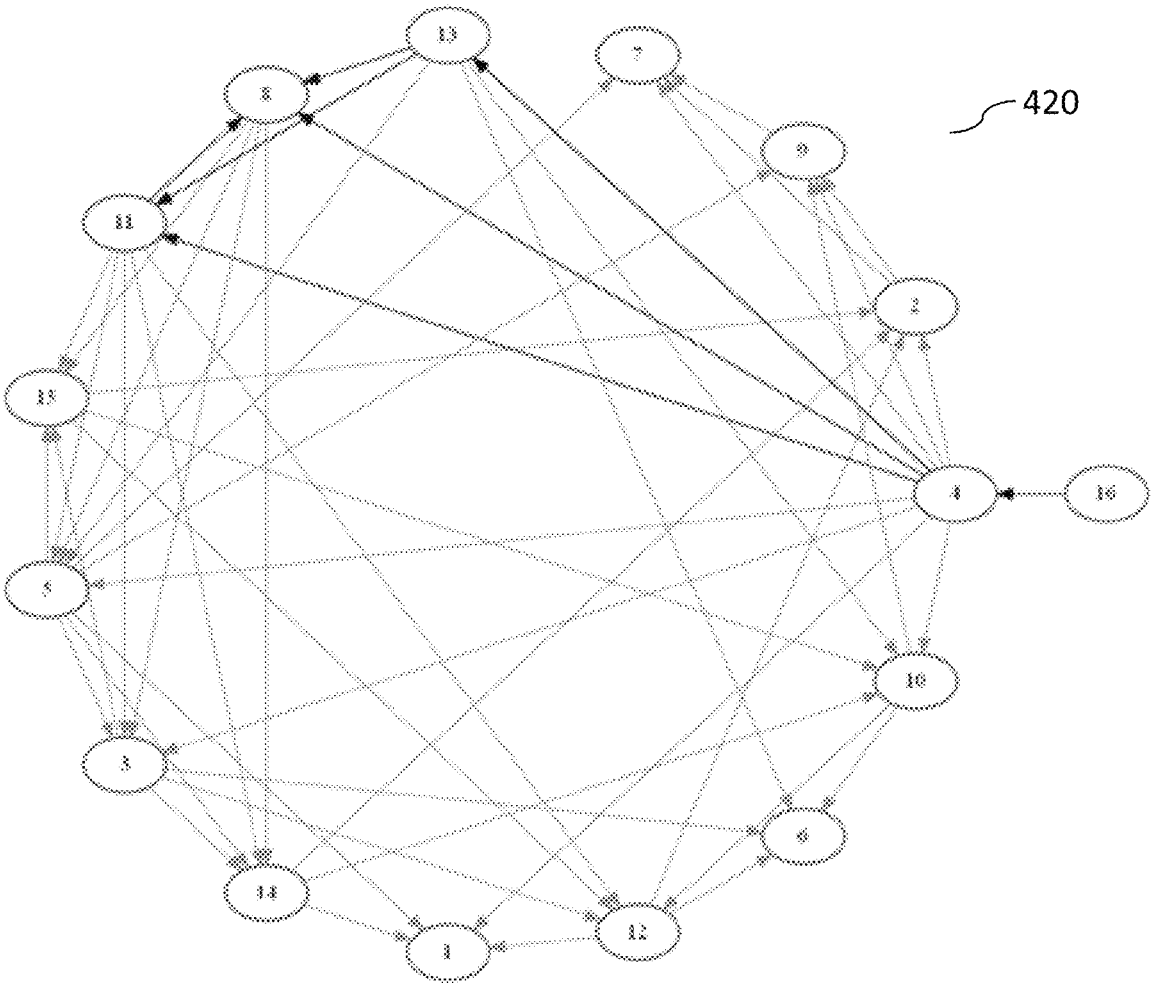
Figure 4C:
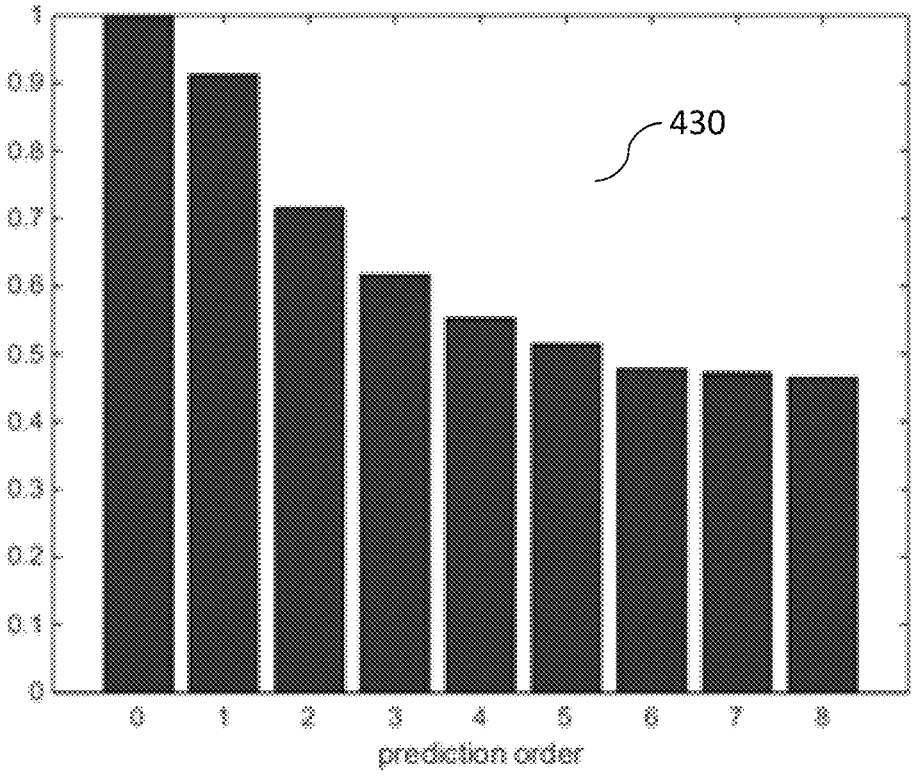
Figure 5A:
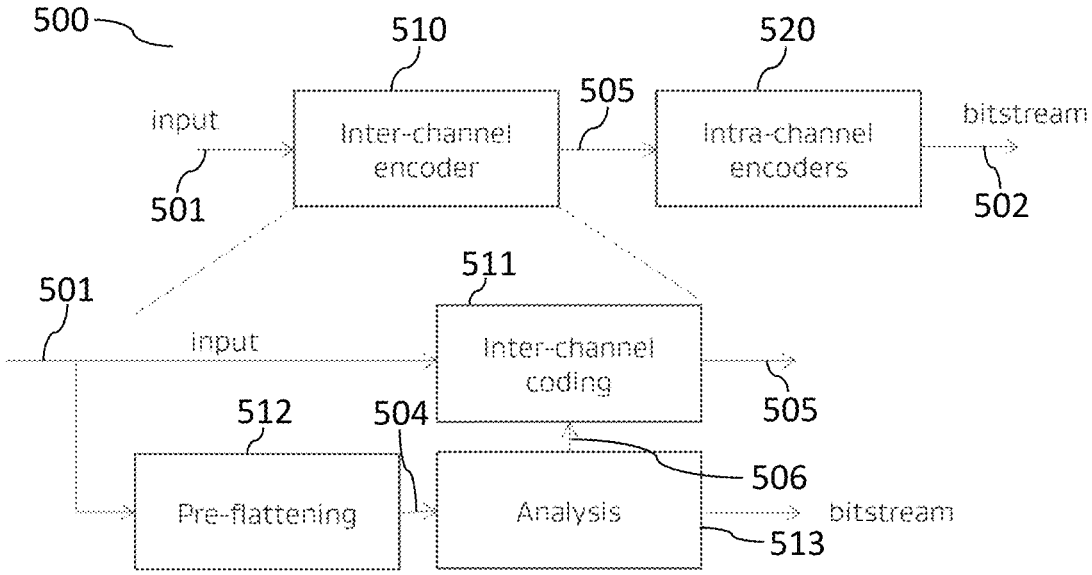
Figure 5B:
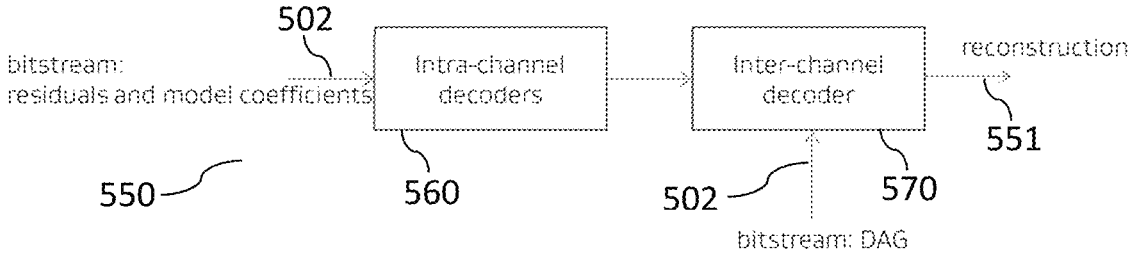
Figure 6A:
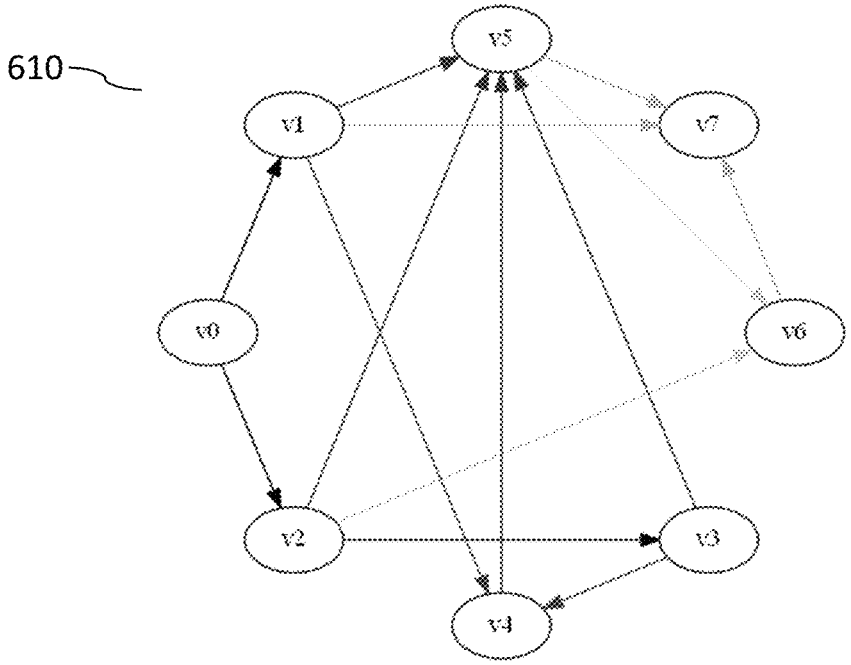
Figure 6B:
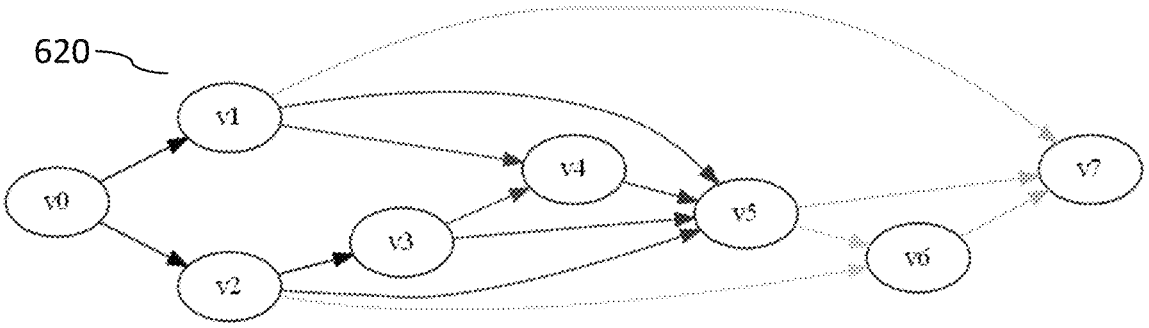
Figure 7:
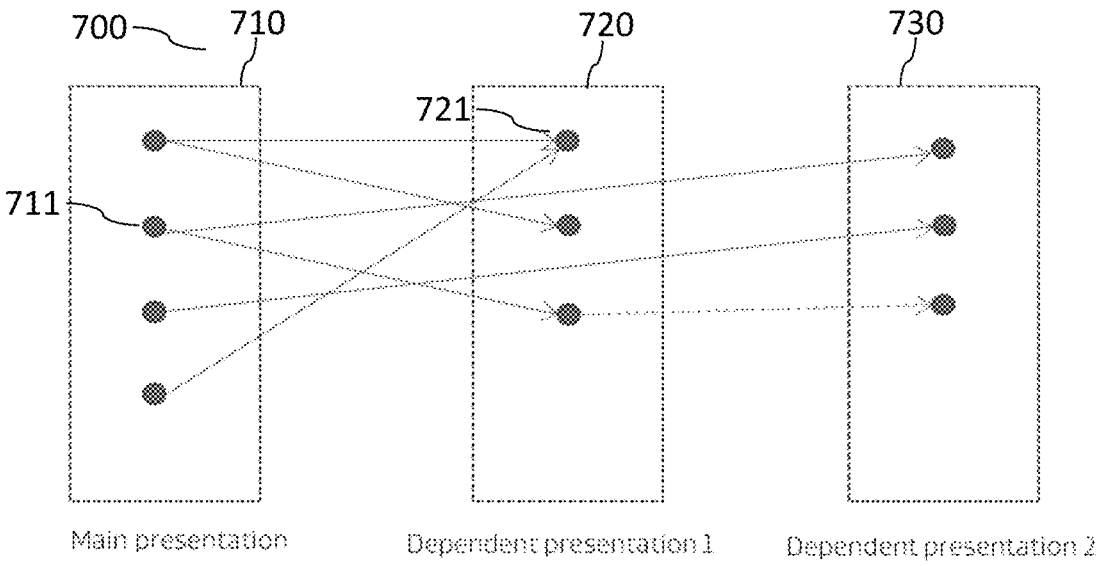
Figure 8A:
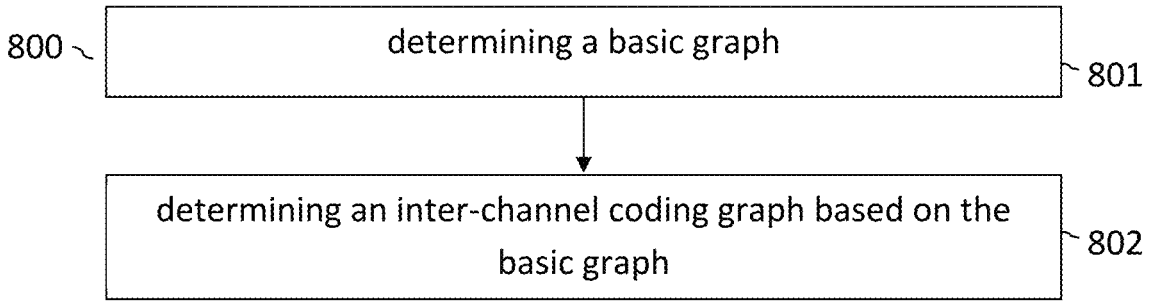
Figure 8B:
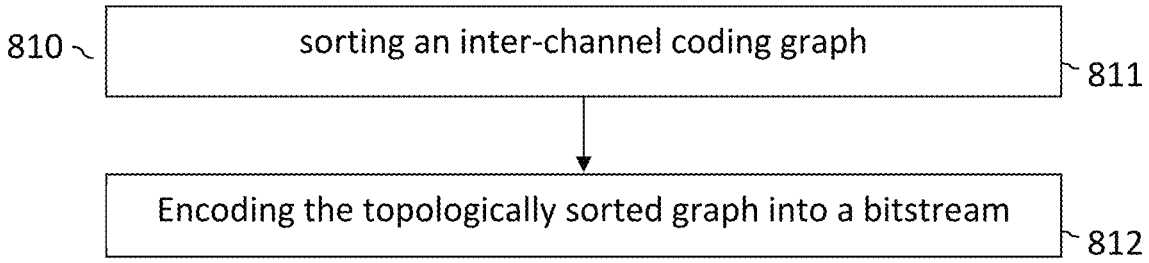
Figure 8C:
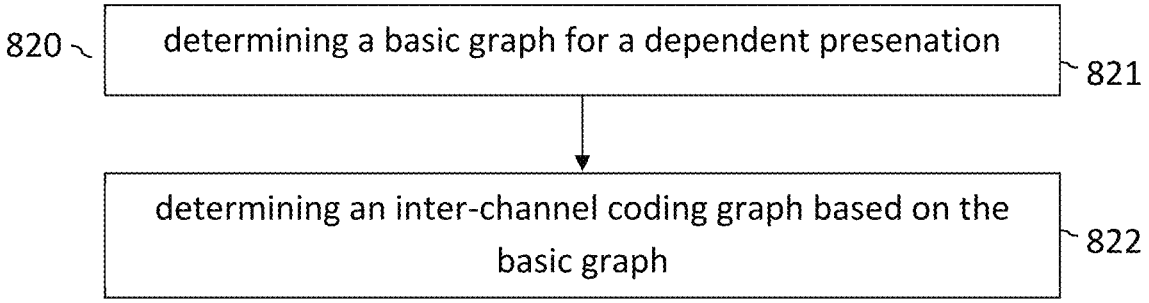
Figure 9:
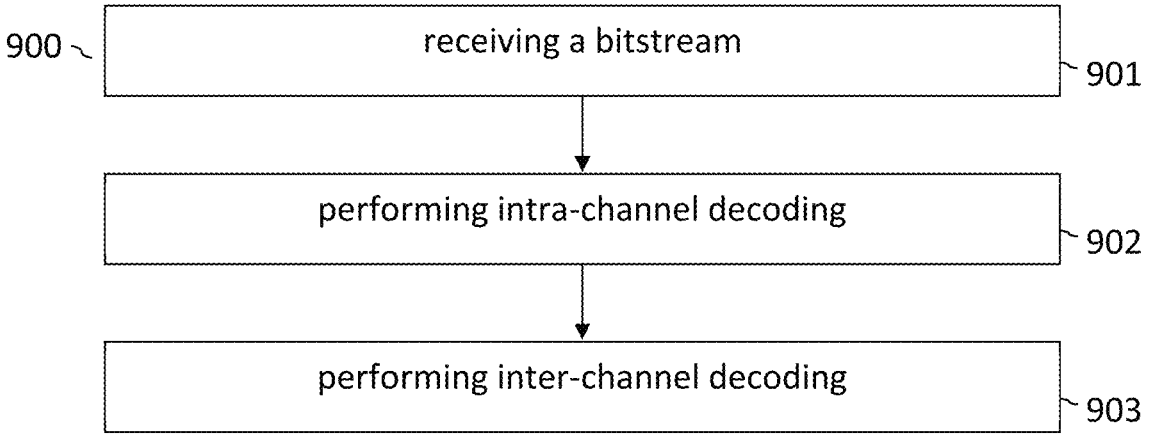

The invention is explained below in an exemplary manner with reference to the accompanying drawings, wherein FIGS. 1*a* to 1*d* show example graphs for describing channel dependencies;

FIGS. 2*a* to 2*b* illustrate an example scheme for optimizing a graph;

FIGS. 3*a* to 3*d* illustrate an example scheme for removing cycles within a higher prediction order graph;

FIG. 3*e* shows a flow chart of an example method for determining a higher order prediction graph from a first order prediction graph;

FIG. 4*a* shows an example first order prediction graph;

FIG. 4*b* shows an example graph for higher prediction orders;

FIG. 4*c* shows example coding gains for different prediction orders;

FIG. 5*a* shows a block diagram of an example multi-channel encoder;

FIG. 5*b* shows a block diagram of an example multi-channel decoder;

FIGS. 6*a* to 6*b* illustrate an example scheme for ordering an inter-channel coding graph;

FIG. 7 illustrates an audio signal comprising multiple presentations;

FIGS. 8*a* to 8*c* show flow charts of example methods for encoding a multi-channel audio signal; and FIG. 9 shows a flow chart of an example method for decoding a bitstream representative of an inter- and intra-channel encoded multi-channel audio signal.

DETAILED DESCRIPTION

As outlined above, the present document is directed at inter-channel coding of a multi-channel audio signal. The dependencies between different channels of a multi-channel audio signal may be described using a directed acyclic graph (DAG), which describes how one or more channels of the multi-channel audio signal may be predicted by one or more other channels of the multi-channel audio signal. The dependencies between one or more channels may be described on a frame-by frame basis, thereby providing a DAG for each frame of a multi-channel audio signal. A frame may comprise the samples of an excerpt of the multi-channel audio signal, e.g. with a temporal length of 20 ms.

It is a goal of an inter-channel encoder to exploit dependencies among the channels of a multi-channel audio signal in order to achieve a coding gain and/or an improved compression ratio. The coding gain may be achieved by exploiting similarities between the channels (e.g. on a frame-by-frame basis). The similarities may be exploited using an inter-channel predictive scheme, where one channel is predicted from one or more other channels of the multi-channel audio signal.

The problem of finding an optimal predictor for (lossless) coding of a multi-channel audio signal may be formulated as a constrained optimization problem. The objective is to minimize the cost of transmitting the channels, subject to a constraint that the associated processing is invertible in a bit exact manner (in order to provide a lossless codec). The graph-based prediction approach which is described herein provides a solution to such a constrained optimization problem. The solution which is provided by the optimization problem has the form of a DAG.

Notation is explained in reference to FIG. 1*a*. The upper portion of FIG. 1*a* illustrates two channels A and B that are represented by the nodes 111 of the graph 110. Channel B may be encoded by performing a prediction of channel B from channel A using a predictor P. The prediction process leads to a prediction error that is represented by a prediction residual, i.e. a residual signal, for channel B. Hence, the content of channel B may be replaced by the residual signal. Encoding the residual signal may be cheaper to code (in terms of the number of bits) than encoding the original audio signal of channel B. By way of example, the residual signal may have a smaller variance than the original signal of channel B, thereby indicating that the residual signal allows for an increased coding efficiency. The prediction process using the predictor P is represented by a directed edge 112 of the graph 110. In case of lossless coding, a decoder is configured to reconstruct the original signal of channel B in a lossless manner given the original signal of channel A, the prediction coefficient P and the residual signal of channel B.

The notion of a graph can be extended to a higher order prediction case. The second order prediction case is illustrated in the graph 115 at the lower part of FIG. 1*a*. The two channels A and B are used to predict channel C.

The contributions from channels A and B are denoted by two graph edges 112. Each edge 112 is associated with a prediction coefficient (a and b, respectively). Once the prediction coefficients are determined, the original content (i.e. the original signal) of channel C is replaced by the prediction residual (i.e. by the residual signal). At the decoder, channel C may be reconstructed in a lossless manner, if and only if the signals of channels A and B have been reconstructed beforehand.

In practice, the dependencies among the channels of a multi-channel signal may be complex and thus the graph 110, 115 representing the different predictors may have a complex structure. It can be shown that the lossless reconstruction property holds as long as the resulting graph 110, 115 is free of directed cycles. The presence of a cycle within a graph 110, 115 implies that a channel within the cycle needs to be decoded before the channel can be decoded, which implies that the channel is not decodable at all.

Figure 1B:
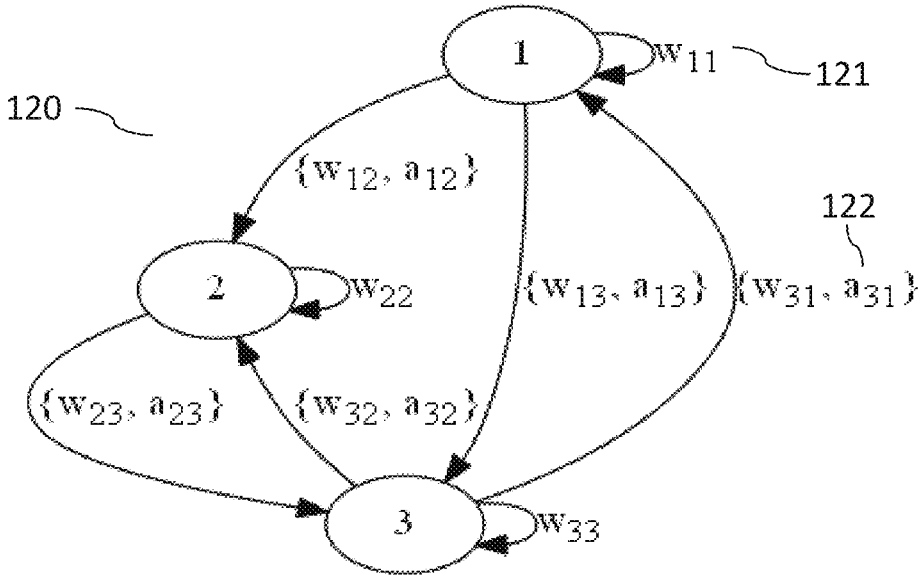

The use of different predictors for encoding the dependencies of the channels of a multi-channel signal has different impact on the performance of the encoder. It is desirable to select an efficient set of predictors for encoding the dependencies of the channels of a multi-channel signal, such that the set of predictors is described by a cycle-free graph 110, 115. It should be noted that self-cycles, which indicate that a channel is predicted from itself, may be allowed. The use of a set of predictors for describing the dependencies of an example multi-channel audio signal is illustrated in FIG. 1*b*. The graph 120 of FIG. 1*b* makes use of first order prediction. The graph 120 shows an example set of possible predictors. The various possible choices of predictors are represented by the graph edges 112. Each edge 112 (except the self-cycle edges) is associated with a prediction coefficient 122 (which may be denoted by $a_i$). Furthermore, each edge 112 is associated with a prediction cost 121 (which may be denoted by $w_i$).

There may be different ways for defining the prediction cost 121. For example, the prediction cost 121 may be represented by the variance of the resulting residual signal. Therefore, for a self-cycle, the weight or prediction cost 121 may be equal to the variance of the original signal of the corresponding channel itself and for all the other edges 112 the cost 121 may be equal to the variance of the respective residual signal.

It can be seen that the graph 120 in FIG. 1*b* contains cycles. In addition, the graph 120 contains multiple options for encoding a particular channel. For example, channel 1 may be coded independently (by selecting the self-cycle $w_{11}$) or it may be predicted from channel 3 (using prediction coefficient $a_{31}$). Hence, the graph 120 shown in FIG. 1*b* needs to be simplified and/or optimized by removing one or more of the edges 112 to make sure that the overall cost 121 of coding of the channels is minimized and to make sure that there are no cycles (except self-cycles). In other words, the optimization goal for optimizing a graph 120 is to provide a graph 120 which exhibits a minimum overall cost (and which does not comprise cycles, except self-cycles). This graph 120 corresponds to the optimal inter-channel coding of the channels of a multi-channel audio signal.

Figure 1C:
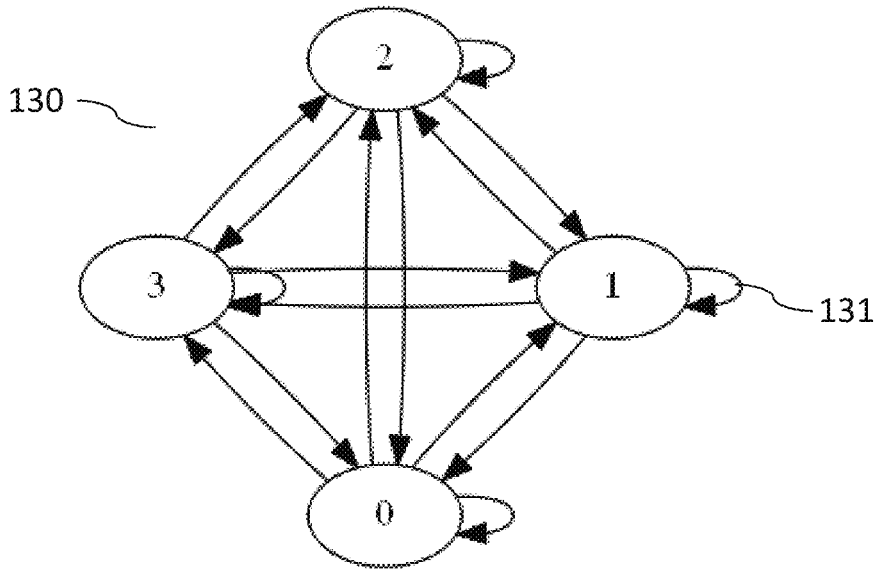
Figure 1D:
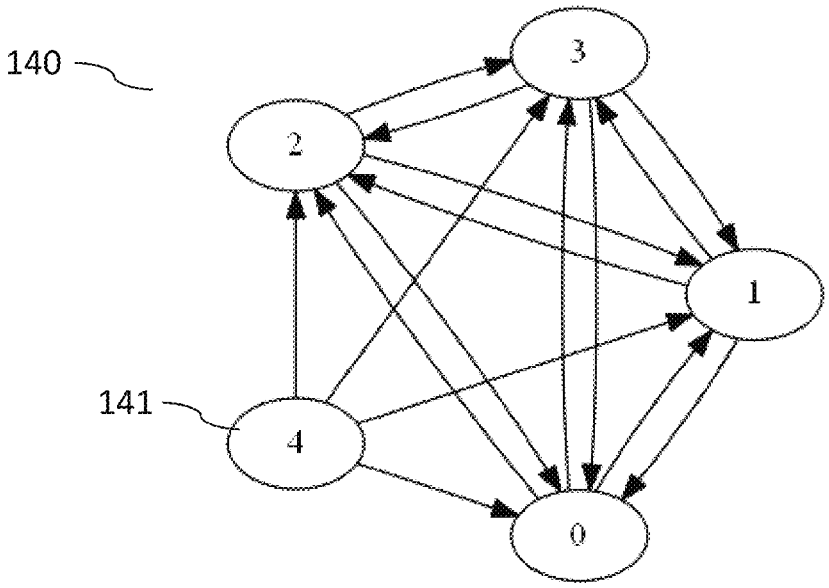

In practice, it may be cumbersome to solve graph problems allowing for self-cycles but disallowing other cycles. In order to simplify the definition of the optimization problem, a graph 130 with self-cycles 131 (as shown in FIG. 1*c*) may be converted into a graph 140 with no self-cycles (as shown in FIG. 1*d*). This may be achieved by introducing a dummy vertex or dummy node 141 with only outgoing connections or edges 112, wherein the outgoing connections or edges 112 represent the self-cycles 131. The dummy node 141 typically corresponds to a dummy channel with a signal with all zeros, such that a channel which is predicted from the dummy channel exhibits a residual signal which corresponds to the original signal of that channel. The dummy channel is typically not encoded into a bitstream. In other words, the dummy channel is typically not required by a decoder for reconstructing an inter-channel encoded multi-channel audio signal.

The selection of an optimal set of predictors for a frame of a multi-channel signal is a non-trivial problem. The number of possibilities for the graph construction is enormous and increases rapidly with the increasing number of channels (i.e. nodes 111). For example, for the case of five channels (including one dummy channel), a cycle-free graph from a set of 543 different possible acyclic graphs needs to be selected. In case of six channels, the number of possible graphs goes up to 29281, etc.

In general, it is therefore not possible to enumerate and compare all possible graphs 140 by means of an exhaustive search, since this would imply prohibitive computational complexity, even when it comes to evaluating the performance of the individual graphs 140. In addition, a high computational cost may be associated with determining the prediction coefficients 122 and the weights 121 associated with the edges 112 of the graphs 140.

A low-complexity method of determining a graph 140 which exhibits good coding gain is described. The method is also outlined in the context of FIG. 8*a*. In a first step, a method directed at the (basic) first order prediction case or differential coding is described. In a second step, an algorithm for constructing a graph 140 that uses higher-order predictors is described. The proposed algorithm for higher-order predictors makes use of orthogonal matching pursuit on a graph 140 in order to improve over the optimal first order predictor solution.

The algorithmic steps for determining a graph using first order prediction may be as follows:

1. Compute an initial graph 130 and edge costs 121 (as specified by method step 801 of method 800 shown in FIG. 8*a*): The initial connectivity matrix for a graph 130 with N nodes, i.e. for a multi-channel audio signal having N channels, has a size of N×N. The diagonal entries of such matrix correspond to the cost 121 of coding the respective channels independently. The off-diagonal entries correspond to the cost 121 of coding the residual signals obtained from predictive coding for a pair of target and source channels, wherein the target channel may be indicated by the row index of the matrix and wherein the source channel may be indicated by the column index of the matrix. Some edges 112 between different nodes 111 (i.e. different changes) may be excluded already during the construction of the graph 130. For example, if the predictor of a channel does not provide a gain compared to an independent coding of a channel, the matrix entry and the edge 112 corresponding to this predictor may be omitted. Hence, off-diagonal entries of the connectivity matrix which indicate a higher cost than a corresponding diagonal entry may be excluded from the graph 130.
2. Convert an N node graph 130 into an N+1 node graph 140 according to FIGS. 1*c* and 1*d*. The added (dummy) node may be selected to be the root node of the graph 140. By doing this, the self-cycles of the graph 130 may be removed.
3. Find the minimum directed spanning tree on the graph 140 with N+1 nodes 111 starting with the root node (as specified by method step 802 of method 800 shown in FIG. 8*a*). The search results in an optimized graph, which has the form of a minimum directed spanning tree. Hence, the tree which interconnects all the nodes 111 and which provides for an overall minimum cost of the edges 112 and which does not comprise any cycles may be determined for determining the optimized graph.
   a. Hence, the optimization problem becomes equivalent to the problem of visiting every node 111 in the graph 140, starting at the root node, while avoiding loops and while minimizing the total cost. In graph theory, this problem is known as finding the minimum directed spanning tree.
   b. All the edges 112 in the graph 140 are associated with an edge cost 121 (e.g., equal to the variance of the resulting residual signal) and are associated with a prediction parameter 122 of a predictor associated with that edge 112.
4. Apply the optimized graph to the coded signal, in order to replace the original signals of the multi-channel audio signal by a set of inter-channel encoded signals comprising one or more original signals and comprising zero, one or more residual signals. The set of inter-channel encoded signal may subsequently be encoded using an intra-channel encoder. Furthermore, a specification of the optimized graph (possibly including the predictions coefficients 122) may be generated for inclusion into a bitstream that is to be transmitted to a corresponding decoder.
   a. Once the optimized graph is determined, it may be applied to the channel signals of the multi-channel signal. The application of the graph occurs in a non-recursive manner. By way of example, a path 1→2→3 in the optimized graph indicates that the channel signal of channel 2 is replaced by a residual signal obtained by using the prediction from the channel signal of channel 1. Subsequently, the channel signal of channel 3 is predicted from the reconstructed channel signal of channel 2 (and not from the residual signal for channel 2).

b. The result of the first-order optimization is a tree, which is a special case of a directed acyclic graph. In order to minimize the computational and memory requirements for the decoder, the encoder may perform topological sorting of the optimized graph before encoding the graph structure into the bitstream.

The above mentioned algorithmic step 3 may be implemented using a graph optimization algorithm. Typical names for such graph optimization algorithms are a minimal directed spanning tree, a minimal branching or a minimum cost arborescence. It should be noted that the more commonly used term "minimal spanning tree" usually refers to the undirected version of the graph optimization algorithm, which may be solved by a different algorithm.

A possible algorithm for finding the minimal cost arborescence is known as Edmonds' algorithm, which is described in Chu, Y. J.; Liu, T. H. (1965), "On the Shortest Arborescence of a Directed Graph", Science Sinica 14: 1396-1400; Edmonds, J. (1967), "Optimum Branchings", J. Res. Nat. Bur. Standards 71B: 233-240; and/or Tarjan, R. E., (1977), "Finding Optimum Branchings", Networks 7: 25-35. These documents are incorporated herein by reference.

The complexity of the Tarjan version of Edmonds' algorithm is $O(N^2)$, where N is the number of nodes 111 or channels. Hence, an optimized graph may be determined in a computationally efficient manner.

An example of the application of the graph optimization algorithm is illustrated in FIGS. 2*a* and 2*b*. A frame of a 5.1 multi-channel signal is considered and a basic graph 210 is constructed using an initial connectivity matrix. In order to construct the basic graph 210, edges 112 having a cost 121 which is higher than the cost 121 for encoding a channel individually may be omitted. In the illustrated example of FIG. 2*a*, the channels L, R, C, LFE, LS, RS correspond to nodes 0, 1, 2, 3, 4, 5, respectively. Node 6 is the dummy node that represents the self-loops. The edge labels of an edge 112 between a source node 111 and a target node 111 represent the cost 121 for coding the target node 111.

Using a graph optimization scheme an optimized graph 220 as shown in FIG. 2*b* may be determined. The optimized graph 220 is decodable since it does not contain any cycles. Furthermore, the optimized graph 220 minimizes the total cost of coding the signals using intra-channel coding. Based on the optimized graph 220, the encoder may generate a set of residual signals. The residual signals may be encoded using a lossless intra-channel coding scheme.

In the following, sum/differential coding is described as an example for first order predictive coding. The predication parameters are either −1 or 1 (to take into account a possible phase inversion). Each edge 112 of a first order graph 220 represents a prediction operation. For example, for an edge 112 going from a source node $X_n$ to a target node $X_m$, the associated predictor is given by $$\begin{bmatrix} X_n \\ R_m \end{bmatrix} = \begin{bmatrix} 1 & 0 \\ a_{nm} & 1 \end{bmatrix} \begin{bmatrix} X_n \\ X_m \end{bmatrix}, \qquad \text{Eqn. No. (1)}$$

where $a_{nm}=\{-1,1\}$ is the prediction parameter 122 and where $R_m$ is the prediction residual signal. The sign of the prediction parameter $a_{nm}$ may be determined while designing the initial cost matrix by selecting the more cost efficient predictor for a specific channel pair. The algorithmic steps for performing differential inter-channel prediction are described in Table 1.

TABLE 1

```
Input: N-channel input signal X
Output: N-channel output signal R (residual signals)
        (N+1) × (N+1) connectivity matrix of prediction coefficients P
[W, P] = Compute_Cost_Matrix_Diff_Coding(X)
W = Find_Minimum_Directed_Spanning_Tree(W)
P = Update_Prediction_Matrix(P, W)
R = X+P*X // Apply the prediction matrix for determining the residual signals
```

The function Compute_Cost_Matrix_Diff_Coding( ) takes the multi-channel input signal and for each pair of target channel and source channel (indicated by the indexes m and n, respectively) the function computes the resulting (prediction) cost 121 for coding the residual signal $R_m$ using a prediction parameter a. E {-1,1} 122. The cost 121 for coding the residual signal $R_m$ is compared to the (direct) cost for coding the channel signal $X_m$ of the target channel independently. If the resulting prediction cost 121 is lower and the direct cost 121, the prediction matrix P(m, n) (which indicates the prediction parameters used for inter-channel coding) is updated with the selected prediction parameter $a_{nm}$ and the resulting cost 121 is inserted into the cost matrix W(m,n). If the differential coding mode does not reduce the cost 121 for coding the target channel, the edge 112 representing the entry w(m,n) within the cost matrix W(m,n) is removed from the basic graph 210 (for example, by assuming an infinite cost 121 of this edge 112).

There may be several ways for computing the cost 121 of an edge 112. For example, the cost entry w(m,n) of the cost matrix W(m,n) may be set to be equal to the variance of the residual signal $R_m$ while using the channel signal $X_n$ of the source channel n as the source for prediction. Alternatively or in addition, the cost entry w(m,n) of the cost matrix W(m,n) may be set to the number of bits need to encode the residual signal $R_m$ while using the channel signal $X_n$ of the source channel n as the source for prediction. Alternatively or in addition, the cost entry w(m,n) of the cost matrix W(m,n) may be (proportional to) the absolute value of the (m,n) element of an inter-channel covariance matrix of the channel signals of the multi-channel audio signal.

The function Find_Minimum_Directed_Spanning_Tree( ) takes the cost matrix W. It may transform the N×N cost matrix W into a (N+1)×(N+1) matrix according to the graph transformation shown in FIGS. 1*c* and 1*d*. Edmonds' algorithm may be used to simplify the basic graph 210, resulting in a minimum directed spanning tree or graph 220 represented by an updated cost matrix W. The optimized graph 220 may be referred to as the inter-channel coding graph.

The function Update_Prediction_Matrix( ) takes as an input the matrix P(m,n) of prediction coefficients 122 and the simplified cost matrix W representing the optimized inter-channel coding graph 220. The function updates the prediction coefficient matrix by keeping only those coefficients 122 that are associated with the edges 112 that have been maintained within the optimization process (as specified by the updated or simplified cost matrix W). In other words, only the prediction coefficients 122 of the edges 112 of the inter-channel coding graph 220 may be maintained within the cost matrix W.

In the following, the first order prediction case using optimized prediction coefficients 122 is described. In particular, non-binary prediction coefficients 122 may be used. The prediction coefficients 122 may be determined using a least squares criterion. In such a case, the prediction coefficient 122 for predicting the channel signal $X_m$ of the target channel in from the channel signal $X_n$ of the source channel n may be given by $$a_{nm} = -\frac{X_n X_m^T}{X_n X_n^T}. \quad \text{Eqn. No. (2)}$$

It should be noted that another criterion for determining the prediction coefficients $a_{nm}$ may be used, for example by performing a search over a set of admissible values of $a_{nm}$ and by finding a prediction coefficient 122 from the set of admissible values that minimizes the number of bits required by the intra-channel encoder for coding the residual signal $R_m$.

The pseudo code of a method for first order prediction coding corresponds to the code shown in Table 1. However, in case of first order prediction coding, the function Compute_Cost_Matrix_Pred(X) computes for each combination of target channel signal $X_m$ and source channel signal $X_n$ a prediction coefficient $a_{nm}$ and the associated cost 121 of the resulting residual $R_m$. The prediction coefficients 122 and the costs 121 are inserted into prediction matrix P and the cost matrix W, respectively. The diagonal entries of prediction matrix P may be set to zero and the diagonal entries of cost matrix W may be set to the cost 121 for encoding the input or channel signals of the N channels. If a prediction coefficient 122 is zero, the associated entry of cost matrix W may be set to infinity or may be removed from the basic graph 210. The other functions are the same as for the differential coding case.

In the following, higher order prediction is described. In particular, a scheme is described which allows the prediction order to be adapted in a flexible manner. For an N-channel signal, the maximum prediction order is N−1. In general, a graph may be constructed where all the possible prediction cases are represented. However, this would substantially increase encoder complexity, due to the graph optimization process and due to the computational cost for determining the prediction coefficients 122 associated with the edges 112 of the graph. Each edge 112 of the graph would be associated with N−1 prediction coefficients for the N−1 different prediction orders.

An algorithm is described that enables higher order prediction with relatively low computational cost. The algorithm is directed at improving the performance of the encoder compared to the first-order prediction case by employing one or more higher order predictors. The algorithm works in an iterative manner: It starts with determining the best first order solution and then recursively updates the first order solution by moving through the nodes 111 of the graph 220 and by increasing the prediction order.

The algorithmic steps of a method 350 for a higher order prediction coder are shown in FIG. 3*e* and are as follows:

1. The algorithm 350 is initialized by determining 351 an optimized graph 220 for the first order prediction case (p=1). In this case, each node 111 only has a single incoming edge 112 from another node 111. The predictor cost 121 may be associated with a (predicted) node 111 instead of the edge 112 leading to this node 111. The cost of the dummy (root) node may be set to 0. The optimized graph 220 which has been obtained using one or more predictors of prediction order p may be referred to as a $p^{th}$ order graph.
2. For each node 111 (i.e. for each target channel) of the $p^{th}$ order graph, the best (p+1)-order prediction may be determined using an orthogonal matching pursuit algorithm (step 352). Following the orthogonal matching pursuit principle, while going from $p^{th}$ order predictor to the $(p+1)^{th}$ order predictor, the associated graph edges 112 for the $p^{th}$ order solution are preserved and one new edge 112 is added. After the new edge 112 is added, the prediction coefficients 122 for all the edges 112 are updated. The (p+1) order predictor for a node 111 (i.e. for a target channel) should lead to a reduction of the cost 121 of the node 111. In other words, the (p+1) order predictor should reduce the cost 121 for a target channel compared to the p order predictor. Otherwise the (p+1) order predictor may be omitted (and the p order predictor may be maintained). The difference between the old cost (using the p order predictor) and the new cost (using the (p+1) order predictor) may be stored as a cost benefit. The difference or cost benefit indicates the cost improvement which is achieved for a node 111 (i.e. for a target channel) when using a higher order predictor. The cost differences or cost benefits for the different nodes 111 may be used for ranking the different nodes 111. The node 111 or target channel having the highest cost benefit may be ranked first and the node 111 or target channel having the lowest cost benefit may be ranked last.
3. The different nodes 111 may be analyzed according to decreasing values of the cost difference between the old and the new cost 121 (starting with the node 111 having the highest cost difference or cost benefit). For each node 111 that is being analyzed, the effect of adding a new edge 112 to the $p^{th}$ order graph is analyzed, with regards to whether a cycle has been introduced to the graph when adding the new edge 112 (step 353). It should be noted that since an orthogonal matching pursuit scheme is used, all other edges 112 remain unchanged and are already part of a cycle free graph. Three different cases may be considered when analyzing the effect of a new edge 112 to a $p^{th}$ order graph:
   a. The new edge 112 does not introduce a cycle. In this case, the new edge 112 may be maintained and the node cost 121 may be updated accordingly.
   b. The new edge 112 creates a single cycle. A single cycle may be isolated and the removal of the cycle may be formulated as a first order prediction problem, as will be outlined in further detail below.
   c. The new edge 112 creates multiple cycles. In this case, the new edge 112 may be rejected and p-order prediction may be maintained for this node 111.
4. Subsequent to verifying 353 all the nodes 111 of the $p^{th}$ order graph, it may be checked 354 whether the sum of costs 121 of all nodes 111 of the updated $p+1^{th}$ order graph has been decreased. If the overall cost has decreased, the algorithm may continue with the next prediction order by setting p→p+1 and by going to step 2 (i.e. method step 352). Otherwise the algorithm 350 may be terminated, and the $p^{th}$ order graph may be used for inter-channel coding.

FIG. 3*a* shows an example $p^{th}$ order graph 310 as a result of step 1 of the above mentioned algorithm. FIGS. 3*b* and 3*c* show possible results of step 2 of the above mentioned algorithm. Node 7 is analyzed in step 3. FIG. 3*b* shows a $p+1^{th}$ order graph 320 which corresponds to case a, with node 7 being predicted from node 10 in addition to node 6. The new edge going from node 10 to node 7 does not create any cycles and may therefore be maintained.

FIG. 3*c* corresponds to case b of step 3. In particular, FIG. 3*c* shows that node 4 may be predicted from node 7 in combination with node 1. It can be seen that a single cycle is introduced going from nodes 4, to node 10, to node 7 and back to node 4. The subgraph of the $p+1^{th}$ order graph 330 representing the single cycle may be isolated and the cycle removal problem may be formulated as finding a minimum spanning tree through the isolated subgraph 340 (as shown in FIG. 3*d*).

The subgraph 340 in FIG. 3*d* may be obtained as follows: The newly added edge 341 connects nodes 7 and 4. The edge from node 1 to node 4 is replaced by a self-cycle edge 342 and the edge from node 6 to 7 is replaced by a self-cycle edge 343. The cycle through nodes 4, 10 and 7 should be broken in an optimal way. The problem of breaking the cycle can be formulated as a graph optimization problem. One can extract the nodes 4, 10 and 7 from the graph 330 with all the connected edges. As indicated above, the incoming edges from the previous iteration of the orthogonal matching pursuit (OMP) algorithm are replaced by self-cycles 342, 343, 344. As a result of this, all the second order predictors for nodes of the subgraph 340 are represented by a single edge. As can be seen from FIG. 1*d*, breaking the cycle in the subgraph 340 affects only the nodes belonging to the cycle thus facilitating local optimization of the subgraph 340. In addition, a cost may be assigned to each edge, for example:

- the edge 342 from node 1 to node 4 (represented as a self-cycle) represents the cost of refraining from the second order prediction represented by the edges for predicting node 4 from nodes 1 and 7 (as shown in FIG. 3*c*).
- the self-cycle 344 from node 10 to node 10 represents the cost of coding node 10 independently. This would allow to break the cycle by removing the edge from node 4 to node 10 or the edge from node 10 to node 7.
- the edge 343 from node 6 to node 7 (represented as a self-cycle) represents the cost of using the first order prediction to predict node 7. The existence of this edge 343 facilitates breaking the cycle by removing the second order edge from node 10 to node 7.

The subgraph 340 from FIG. 3*d* may be optimized using, for example, Edmonds' algorithm. For this purpose, the self-cycles of the graph 340 may be converted to outgoing edges from a dummy root node.

Step 2 of the above algorithm employs an orthogonal matching pursuit (OMP) scheme. The goal of OMP is to use a set of channel signals (associated with the nodes 111 of the $p^{th}$ order graph 310) stacked into a signal matrix D and to determine a set of (N−1) prediction coefficients such that the least squares error of approximating the channel signal y (associated with the target channel) is minimized $$\min_x \|y - Dx\|_2^2 \text{ subject to } \|x\|_0 < N \qquad \text{Eqn. No. (3)}$$

wherein x is a prediction vector comprising the prediction coefficients 122. The l-O norm in the above equation indicates the number p of non-zero coefficients in the prediction vector x. This number p should not be higher than N−1.

Step 3 of the above algorithm makes use of an algorithm for detecting cycles in a graph 330. An example algorithm for doing this is a depth first search (DFS) algorithm as described e.g. in Mehlhorn, Kurt; Sanders, Peter (2008). Algorithms and Data Structures: The Basic Toolbox). This document is incorporated by reference.

In an example, a 15-channel signal may be considered. An inter-channel covariance matrix may be provided for (a frame of) the 15-channel signal. The first order graph 410 using first order prediction is shown in FIG. 4*a*. The result of OMP refinement, where the maximum prediction order is constrained to p=4, is shown as the fourth order graph 420 in FIG. 4*b*.

By increasing the maximum prediction order in the OMP-based optimization scheme, coding efficiency may be increased, since more complex dependencies among the channels of the multi-channel audio signal can be captured by the structure of the predictors. This is illustrated in FIG. 4*c*, which shows the compression ratio 430 as a function of the prediction order. It can be seen that the performance of the coder improves (i.e., the compression ratio 430 decreases) as the prediction order increases. The prediction order 0 indicates independent coding of the channels of a multi-channel signal.

The proposed codec makes use of prediction with scalar prediction coefficients. This means that a single sample of a source channel signal can be used to predict a single sample of a target channel signal. The prediction scheme may be generalized to a scheme, where a single sample of a target channel signal is predicted from multiple samples of a source channel signal. The problem that arises in the context of lossless predictive coding of multiple channels is how to obtain the best set of predictors for the different channels, subject to the invertibility constraint.

A sample of a coded channel signal may be denoted by $S_J[t]$. The set of nodes used to predict the J-th channel may be denoted by Z. A vector of prediction coefficients 122 to predict the J-th channel from the i-th channel may be denoted by $a_{Ji}$. The k-th element of this vector is $a_{Ji}[k]$. The predictor of $S_J[t]$ can be of the form:

$$S_J[t] = \sum_{i \in Z} \sum_{k=0}^{K-1} a_{Ji}[k] S_i[t-k] + e_J[t], \qquad \text{Eqn. No. (4)}$$

where $e_J[t]$ is a sample of the residual signal, which is transmitted instead of the channel signal $S_J[t]$ of the target channel.

The decoder can reconstruct $S_J[t]$ once it has access to the prediction vector a and to all the channels i involved in the prediction with $i \in Z$. The performance gain attributed to a particular choice of predictor may be determined for a particular node. Hence, the optimal composition of the set Z may be determined for every node in the graph. In other words, the approach described herein, which is based on the optimization of a graph, facilitates the selection of good predictors for all the channels of a multi-channel signal, given the no-cycle constraint. The problem may be solved using the no-cycle constraint and the result of the optimization may be a DAG, which guarantees that the encoded multi-channel signal can be reconstructed at the decoder.

FIG. 5*a* shows a block diagram of an example encoder 500. The encoder 500 comprises an inter-channel encoder 510 which is configured to perform the inter-channel encoding of a multi-channel input signal 501 as described herein. The inter-channel encoded signal 505 comprises at least one channel signal from the original multi-channel input signal 501 and zero to N−1 inter-channel encoded residual signals (in case of an N-channel input signal 501). The subsequent intra-channel encoder 520 performs intra-channel encoding of each channel signal from the inter-channel encoded signal 505, to provide a bitstream 502. The bitstream 502 comprises data regarding the encoded channel signals of the inter-channel encoded signal 505. Furthermore, the bitstream 502 comprises data regarding the inter-channel coding graph 420 which has been used for inter-channel coding and data regarding the prediction coefficients 122 which have been used for inter-channel coding.

In lossless coding, the intra-channel encoding is typically the most important component in terms of compressing a multi-channel audio signal 501. Nevertheless, the gains from inter-channel coding are typically non-negligible. In the encoder 500 of FIG. 5*a*, the inter-channel and intra-channel coding are performed in a cascaded manner. A problem related to the construction of a multi-channel encoder 500 is to achieve overall optimal performance using a cascade of the encoder units 510, 520. In particular, the encoding decisions which are made within the inter-channel encoder 510 may impact the encoding gain which is achieved by the subsequent intra-channel encoder 520.

The channel signals of the inter-channel encoded signal 505, which are fed to the intra-channel encoder 520 are obtained by means of the inter-channel encoder 510. This means that for optimizing the overall encoder performance, the residual signals 503 which are obtained from inter-channel coding should be generated in a way that facilitates subsequent intra-channel coding. In other words, the inter-channel encoder 510 should take into account the operation of the subsequent intra-channel encoder 520 when performing inter-channel encoding. However, since the residual signals 503 are not known prior to performing inter-channel coding, the operation of intra-channel coding typically cannot be predicted exactly.

The encoder 500 shown in FIG. 5*a* solves the above issue by making use of a pre-flattening unit 512 which is configured to perform (spectral) pre-flattening of the channel signals of the multi-channel input signal 501 prior to computation of prediction coefficients 122 and the costs 121 (as described above). The pre-flattening may be implemented, for example, by means of linear prediction coding (LPC) with a specified LPC order. As a result of the pre-flattening, a set of pre-flattened channel signals 504 is obtained. The DAG 506 for performing inter-channel encoding (including the prediction coefficients 122) may now be determined based on the pre-flattened signals 504 within an analysis unit 513. In other words, the pre-flattened signals 504 are used for determining a DAG 506 according to the methods described herein. On the other hand, the DAG 506 may be applied to the channel signals of the original multi-channel input signal 501 (within an inter-channel encoding unit 511), in order to determine zero, one or more residual signals of the inter-channel encoded signal 505. By doing this, an optimized DAG 506 for inter-channel encoding, which takes into account the subsequent intra-channel encoding, may be performed.

The bitstream 502 which is generated by the encoder 500 may be designed in such a way that the complexity of a decoder of the bitstream 502 is reduced and/or minimized Typically, the decoding process should exhibit low computational complexity and low memory requirements. For this purpose, the nodes 111 of a DAG 506 which describes inter-channel encoding may be topologically sorted. The sorting process may be offloaded to the encoder 500, wherein an algorithm (e.g., the Kahn algorithm) may be used to sort the graph 506.

An example of such a sorting process is illustrated in FIGS. 6*a* and 6*b*. The graph 610 shown in FIG. 6*a* may have been determined within the inter-channel encoder 510 (notably within the analysis unit 511). This means that the channels represented by nodes v1 and v2 are encoded independently (v1 and v2 have direct incoming connections from the dummy node v0);

the channel represented by node v7 is coded predictively using channels v1, v5 and v6; and the channels represented by nodes v6 and v4 are coded using second order predictors and are predicted from channel pairs {v5, v2} and {v3, v1}, respectively.

The graph 610 is to be transmitted to the decoder. The method for determining the graph 610 ensures that the graph 610 is decodable since the graph 610 does not comprise any directed cycles. Topological ordering of the graph 610 may be performed at the encoder 500 using e.g. the Kahn algorithm which is described in Kahn, Arthur B. (1962), "Topological sorting of large networks", Communications of the ACM, 5 (11): 558-562. This document is incorporated herein by reference.

The result of topological sorting of the graph 610 is shown by the topologically sorted DAG 620 in FIG. 6*b*. The bitstream 502 may make use of a bit-stream syntax that can accommodate arbitrary ordering of the channels and an arbitrary order of the prediction. The signaling of the predictor configuration, i.e. of the sorted graph 620, may be achieved by traversing the topologically sorted graph 620 and by signaling a node index of a node 111 and indices of one or more incoming connections to the node 111. Hence, the bitstream syntax may facilitate conveying the indices of different target nodes in an arbitrary order.

For transmitting the sorted graph 620 of FIG. 6*b*, the graph 620 may be traversed from left to right to determine the order in which target nodes 111 and their incoming edges 112 are inserted into the bitstream 503. In the illustrated example of FIG. 6*b*, the following order may be used: v1, v2 followed by v3, followed by v4, followed by v5, followed by v6 and followed by v7.

Transmitting a topologically sorted graph 620 results in a simplification of the decoder structure. In particular, the transmission of a sorted graph 620 ensures that for any channel that is to be decoded, all the channels involved in the prediction of that channel are already available at the decoder. As a result of this, memory and processing requirements at the decoder may be reduced.

It has been found that high order prediction is selected relatively rarely compared to low order prediction. In order to achieve an efficient transmission of a sorted graph 620, the maximum prediction order may be limited to a number which is lower than N−1. For each target node 111 that is indicated within the bitstream 502, all incoming nodes to the target node 111 may be enumerated. In the example illustrated in FIG. 6*b*, v0 is indicated for the target node v1; v0 is indicated for the target node v2; v2 is indicated for the target node v3; v3 and v1 are indicated for the target node v5; v1, v4, v3 and v2 are indicated for the target node v5; v5 and v2 are indicated for the target node v6 and v1, v5 and v6 are indicated for the target node v7.

In order to facilitate transmission of a topologically sorted graph 620 the bitstream syntax may be designed to allow for:

transmitting a target node index followed by its associated source nodes and prediction coefficients; and/or transmitting the above structures in an arbitrary order.

The graph 620 may be updated in a signal adaptive-manner (e.g. on a frame by frame basis) and therefore the bitstream syntax may be designed to facilitate flexibility in time resolution regarding updates of the graph 620.

FIG. 5*b* shows an example decoder 550. The decoder 550 may be configured to perform sequential decoding of the coded channels. The order of decoding is governed by the DAG 506, 620, which can be changed on a per frame basis. As discussed above, the DAG 506 which is determined within the analysis unit 513 of the encoder 500 may be a topologically sorted DAG 620. The graph 506, 620 may be transmitted to the decoder 550 in an arbitrary format and the decoder 550 may determine the correct order of decoding of the channels by following the structure of the DAG 506, 620. As mentioned above, this ordering task is preferably delegated to the encoder 500.

The decoder 550 comprises an intra-channel decoder 560 configured to provide at least one decoded channel signal (e.g. for the channel v0 in FIG. 6*b*) and zero, one or more decoded residual signals (e.g. for the channels v1, v2, v3, v4, v5, v6 and v7 in FIG. 6*b*). Subsequently, an inter-channel decoder 570 performs decoding of the channels according to a topologically ordered DAG 506, 620. As a result of this, a reconstructed multi-channel audio signal 551 is obtain, which, in case of lossless coding, is equal to the original multi-channel input signal 501.

Within some embodiments of the proposed method, different presentations of audio content may be transmitted. In particular, in addition to a main presentation, some embodiments may facilitate coding of one or more dependent presentations. The main presentation is self-contained and decoding of the main presentation may be performed without additional information. A dependent presentation may be encoded in a way to exploit dependencies with respect to the main presentation. Hence, the main presentation needs to be decoded (or at least one or more relevant parts of the main presentation need to be decoded) in order to enable decoding of a dependent presentation.

A codec may allow for an arbitrary number of dependent presentations. FIG. 7 shows an example case 700 with a main presentation 710, a first dependent presentation 720 and a second dependent presentation 730. The main presentation 710 comprises one or more nodes 711 (i.e. one or more corresponding channels). The main presentation 710 is self-contained, and the encoder 500 determines the optimal DAG 620 for all the nodes 711 (i.e. channels) belong to the main presentation 710.

For encoding the first dependent presentation 710, the encoder 500 has access to all the nodes 711 of the main presentation 710 in addition to the nodes 721 belonging to the first dependent presentation 720. The encoder 500 may use any combination of nodes 711, 721 from the main presentation 710 and from the first dependent presentation 720 for predicting a node 721 of the first dependent presentation 720. However, in order to ensure decodability, the generation of a graph 620 for the first dependent presentation 720 is submitted to the constraint that the connections from the main presentation nodes 711 to the dependent presentation nodes 721 is one-way only (from a main presentation node 711 to the dependent presentation node 721).

As such, layered coding of different presentations or layers 710, 720, 730 may be provided, where a dependent presentation or layer 720, 730 is dependent on a main presentation or layer 710. The dependent layers 720, 730 may be mutually independent (illustrated by the solid lines) or the dependent layers 720, 730 may be mutually dependent (illustrated by the dashed line).

The graph 620 of a dependent layer 720 may be determined as outlined herein, by taking into account one, some or all of the nodes 711 of the main layer 710. Furthermore, the constraint is taking into account that the connections from a main presentation node 711 to a dependent presentation node 721 is one-way only. The additional "one-way" constraint may be taken into account when generating the first order graph by excluding the one or more disallowed connections (from a dependent presentation node 721 to a main presentation node 711) before applying Edmonds' algorithm. For the higher order case, the disallowed connections may also be excluded for the OMP iterations.

The bitstream syntax may be adapted to facilitate efficient signaling of the graph 620 for a dependent layer 720 by taking into account the dependencies among the nodes and, in addition, by performing topological sorting. The sorting for the dependent layer 720 may be achieved by introducing a dummy vertex to the graph 620 of the dependent layer 720, wherein the dummy vertex represents all the external connections to the nodes 721 of the dependent layer 720. Additional dummy vertices may be used for describing complex hierarchies among multiple presentations 710, 720, 730. Subsequent to introducing one or more dummy vertices, the sorting algorithm described herein may be applied for determining a sorted graph 620 for a dependent layer 720.

FIG. 8*a* shows a flow chart of an example method 800 for performing inter-channel encoding of a multi-channel audio signal 501 comprising channel signals for N channels, with N being an integer, with N>1. The method 800 comprises determining 801 a basic graph 210 comprising the N channels as nodes 111 and comprising directed edges 112 between at least some of the N channels. A directed edge 112 from a source channel to a target channel indicates that the channel signal of the target channel is predicted from the channel signal of the source channel, thereby leading to a residual signal for the target channel as a prediction residual. Furthermore, a directed edge 112 indicates a cost 121 associated with coding the residual signal of the target channel.

Furthermore, the method 800 comprises determining 802 an inter-channel coding graph 220 from the basic graph 210. The inter-channel coding graph 220 is determined such that the inter-channel coding graph 220 is a directed acyclic graph. Furthermore, the inter-channel coding graph 220 is determined such that a cumulated cost of the edges 112 of the inter-channel coding graph 220 is reduced compared to a cumulated cost of the edges 112 of the basic graph 210.

Hence, an inter-channel coding method 800 comprising optimization of a directed acyclic graph 220, notably in the context of lossless audio coding, is described. The method 800 is directed at the construction and optimization of a directed acyclic graph (DAG) 220. In lossless coding, all the operations performed on a coded signal must always be invertible in a bit-exact manner. The lossless coding scheme should also provide the best possible coding performance (e.g., measured in terms of compression ratio). The associated inter-channel coding approach may be formulated as a constrained optimization problem of a basic graph 210 and may be solved by a graph optimization algorithm. In this case, the associated optimization problem is likely NP-hard.

A computationally efficient algorithm for optimizing the basic graph 210 is described. The algorithm results in a locally optimal solution, which typically yields good coding performance. The algorithm is based on a concept of orthogonal matching pursuit (OMP), which is performed on the basic graph 210. In particular, a differential coding scheme where the DAG 220 is optimized to obtain a so-called minimum spanning forest or tree is described. Furthermore, the use of a minimum forest solution is applied to a basic graph 220 employing first order prediction. Furthermore, an optimization algorithm for the higher-order prediction case is described.

Hence, a method 800 for inter-channel coding of multi-channel signal 501 comprising a transformation representable by a directed acyclic graph 220 is described. The graph 220 comprises a set of directed edges 112 and a set of nodes 111, wherein each edge 112 is associated with a predictor and each node 111 is associated with a channel. Each directed edge 112 represents a prediction of a target channel from a source channel. Furthermore, each predictor may be characterized by a set of prediction parameters 122 associated with a prediction operation using a source node as the basis for the prediction and a target node as the predictor target.

The graph 220 may be optimized to maximize the coding gain by selection of edges 112 to be included in the directed acyclic graph 220 and by updating the prediction parameters 122 accordingly. The graph 220 may be optimized in a signal adaptive manner. The graph 220 may be optimized in adaptation to the statistical parameters of the coded signals (e.g. the variances of the residual signals).

Multiple source nodes may be used with the graph 220 to predict a signal associated with a single target node 111. The directed acyclic graph 222 may take the form of a directed minimum spanning forest or tree.

The set of prediction parameters 122 may comprise a scalar prediction coefficient. In case of differential coding, the prediction coefficient may take values from the set {-1, 1}.

The forward transformation may be computed from a directed acyclic graph 220. Furthermore, the corresponding inverse transformation may be computed sequentially from a topologically ordered representation of the graph 220.

As outlined herein, the graph 220 may be optimized based on pre-flattened input signals and the graph 220 may be applied to original signals.

The maximum prediction order which is used by a graph 220 may be restricted (to less than N−1), thereby providing an optimal tradeoff between coding gain and coding efficiency.

FIG. 8*b* shows a flow chart of an example method 810 for encoding an inter-channel coding graph 220 which is indicative of inter-channel coding of channels of a multi-channel audio signal 501 into a bitstream 502. The inter-channel coding graph 220 comprises nodes 111 that represent the channels of the multi-channel audio signal 501 and directed edges 112 that represent coding dependencies between the channels.

The method 810 comprises sorting 811 the channels of the inter-channel coding graph 220 to provide a topologically sorted graph 620. The inter-channel coding graph 220 may be sorted such that the channels are assigned to a sequence of positions, and such that a channel assigned to a first position from the sequence of positions can be encoded independently, and such that for each subsequent position from the sequence of positions, a channel assigned to this position can be encoded independently or can be encoded in dependence of one or more channels assigned to one or more previous positions.

Furthermore, the method 810 comprises encoding 812 the topologically sorted graph 620 and/or the multi-channel audio signal 501 into a bitstream 502, such that a decoder 550 is enabled to decode the channels of the multi-channel audio signal 501 in accordance to the positions assigned to the channels.

Hence, an encoder 500, decoder 550, a bitstream 502 and bitstream syntax for an inter-channel coding scheme based on a directed acyclic graph 220, 620 is described. On the encoder side, an inter-channel encoder 510 and intra-channel encoder 520 are combined. The inter-channel coding is performed according to a predictive scheme governed by a DAG 220, 620. The inter-channel coding provides residual signals to be encoded by the intra-channel encoder 520. The graph optimization may be performed using method 800. The bitstream 502 and/or bitstream syntax exploits graph properties and enables offloading of computational complexity from the decoder 550 to the encoder 500. The bitstream 502 and/or bitstream syntax facilitates transmission of a topologically ordered DAG 620, which renders a computationally efficient decoding process possible. Furthermore, a decoding algorithm for a lossless decoder 550 is described, where intra-channel decoding provides input signals for inter-channel decoding.

As such, an encoding method for the inter-channel coding of audio signals is described, wherein the coding scheme uses a set of predictors governed by a directed acyclic graph 220, wherein the scheme generates a set of input signals 505 for an intra-channel encoder 520, and wherein the scheme generates a parametric representation of the graph 220, 620 that is transmitted to the decoder 550. Furthermore, a bitstream 502 and/or bitstream syntax is described which facilitates transmission of the parametric representation of the directed acyclic graph 220, 620 in a topologically sorted order. The bitstream 502 and/or bitstream syntax may exploit sparsity of the graph 220, 620. In addition, a decoder 550 preforming intra-channel decoding generating a set of residual signals, which is followed by inter-channel decoding performed accordingly to the topologically sorted graph 620, is described.

FIG. 8*c* shows a flow chart of an example method 820 for performing inter-channel encoding of one or more dependent channels 721 of a dependent presentation 720 in dependence of at least one main channel 711 of a main presentation 710. It should be noted that the one or more dependent channels 721 may (in addition) be inter-channel encoded in dependence of one or more other dependent channels 721 of the dependent presentation 720.

FIG. 7 only illustrates the edges between different presentations 710, 720. In addition to this, the basic graph 210 for encoding the dependent presentation 720 may comprise one or more edges 112 between the dependent channels 721 of the dependent presentation 720.

The method 820 comprises determining 821 a basic graph 210 comprising the one or more dependent channels 721 and the main channel 711 as nodes 111 and comprising directed edges 112 between at least some of the channels 711, 721. A directed edge 112 between a source channel and a target channel may indicate that the channel signal of the target channel is predicted from the channel signal of the source channel, thereby leading to a residual signal for the target channel as a prediction residual. Furthermore, a directed edge 112 may indicate a cost 121 associated with coding the residual signal of the target channel.

The basic graph 210 may comprise one or more directed edges 112 having the main channel 711 as a source channel. On the other hand, the basic graph 210 may not comprise any directed edges 112 having the main channel 711 as a target channel. By doing this, the dependency direction between the main presentation 710 and the dependent presentation 720 may be ensured, even during optimization of the basic graph 210.

Furthermore, the method 820 may comprise determining 822 an inter-channel coding graph 220 for the dependent presentation 720 from the basic graph 210, such that the inter-channel coding graph 220 is a directed acyclic graph.

Hence, a layered coding scheme based on a constrained directed acyclic graph 220 is described. In particular, a method 820 for layered coding used in a codec extension to a multiple presentation scenario is described. The method 820 may be used to encode a main and a dependent presentation 710, 720. While coding the dependent presentation 720, the encoder 500 may exploit the dependencies between the main and the dependent presentation 710, 720, thereby improving coding performance for the dependent presentation 720. This may be achieved by imposing one or more constraints on the DAG 220 in the course of graph optimization. The method 820 may be used for any number of layers.

A such, a layered-coding scheme for multichannel audio employing a directed acyclic graph 220 is described. The nodes 111 of the graph 220 may be divided into groups representing the layers 710, 720. For each of the layers 710, 720, the graph 220 may be constrained by restricting a set of possible source nodes to a subset of all the nodes 111 and by constraining the set of target nodes to belong solely to a single layer 710. There may be at least two layers: the main layer 710 and the dependent layer 720, wherein the main layer 710 is coded independently and the dependent layer 720 may use signals from the main layer 710 to predict signals belonging to the dependent layer 720. The layers may be dependent recursively.

Furthermore, a bitstream 502 or bitstream syntax utilizing the constrained representation of the graph 220 to facilitate efficient transmission of the graph 220 is described. In addition, a decoder 550 for decoding the signals accordingly to the constrained directed acyclic graph 220 is described.

Furthermore, FIG. 9 shows a flow chart of an example method 900 for decoding a bitstream 502 which is representative of an input multi-channel audio signal 501. The method 900 comprises receiving 901 the bitstream 502, wherein the bitstream 502 is indicative of the intra-channel encoded set of inter-channel encoded signals 505. Furthermore, the bitstream 502 is indicative of the DAG 506, 620 (notably the topologically sorted DAG 620) which has been used for performing inter-channel encoding. In addition, the bitstream 502 may be indicative of the prediction coefficients 122 which have been used for inter-channel encoding.

The method 900 comprises performing 902 intra-channel decoding of the intra-channel encoded set of inter-channel encoded signals 505. For this purpose, an intra-channel decoder 560 may be used which performs inverse operations to the corresponding intra-channel coder 510. As a result of this, a (decoded) set of inter-channel encoded signals is obtained. Furthermore, the method 900 comprises performing 903 inter-channel decoding of the (decoded) set of inter-channel encoded signals. Inter-channel decoding is performed using the DAG 506, 620 and possibly the prediction coefficients 122, which are indicated within the bitstream 502. As a result of inter-channel decoding a reconstructed multi-channel signal 551 is obtained.

The methods and systems described herein may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described herein are portable electronic devices or other consumer equipment which are used to store and/or render audio signals.

The invention claimed is:

1. A method for performing inter-channel encoding of a multi-channel audio signal comprising channel signals for N channels, with N>1; wherein the method comprises, determining a basic graph comprising the N channels as nodes and comprising directed edges between at least some of the N channels; wherein a directed edge from a source channel to a target channel indicates that the channel signal of the target channel is predicted from the channel signal of the source channel, thereby leading to a residual signal for the target channel as a prediction residual; wherein a directed edge indicates a cost associated with coding the residual signal of the target channel;

determining an inter-channel coding graph from the basic graph, such that the inter-channel coding graph is a directed acyclic graph; and a cumulated cost associated with coding the signals of the nodes of the inter-channel coding graph is reduced compared to a cumulated cost associated with independent coding of the channel signals of the multi-channel audio signal; and applying the inter-channel coding graph for inter-channel encoding of at least one channel of the multi-channel audio signal.

2. The method of claim 1, wherein the method comprises determining a direct cost for encoding a particular target channel independently;

the method comprises determining a prediction cost for encoding the particular target channel by prediction from a particular source channel taken from the remaining N−1 other channels; and the basic graph is determined such that the basic graph does not comprise a directed edge from the particular source channel to the particular target channel, if the direct cost is lower than the prediction cost.

3. The method of claim 1, wherein the inter-channel coding graph is determined such that the cumulated cost associated with the channel signal or the residual signal of each of the nodes of the inter-channel coding graph is reduced; and the cumulated cost associated with the signal of each of the nodes of the inter-channel coding graph is reduced compared to a cumulated cost associated with the signal of each of the nodes of another acyclic graph derived from the basic graph.

4. The method of claim 1, wherein the basic graph is determined such that the basic graph only comprises one or more directed edges from a source channel to a particular target channel, if the cost for encoding the residual signal of the particular target channel is lower than a direct cost for encoding the particular target channel independently.

5. The method of claim 1, wherein the cost associated with coding the residual signal of the target channel depends on any of:

a variance of the residual signal;

a number of bits required for encoding the residual signal; and/or an inter-channel covariance of the target channel and the source channel.

6. The method of claim 1, wherein a target channel is predicted from a source channel using any of differential coding with possible prediction coefficients being −1 or 1;

first order prediction; and multiple order prediction.

7. The method of claim 1, wherein the method comprises determining a prediction coefficient for predicting the channel signal of a target channel from the channel signal of a source signal, wherein the prediction coefficient is determined such that the cost for encoding the residual signal of the target signal is reduced, notably minimized, in accordance to a cost criterion, notably a least-square cost criterion, wherein the method comprises determining the prediction coefficients for the directed edges of the inter-channel coding graph; and encoding the prediction coefficients into a bitstream.

8. The method of claim 1, wherein the basic graph and the inter-channel coding graph are represented using a cost matrix comprising as entries the cost for coding the residual signal of a target channel which has been predicted from a source channel and the cost for coding a channel signal of a target channel independently; and a prediction matrix comprising as entries a prediction parameter for predicting a target channel from a source channel, wherein the different columns of the cost and prediction matrix correspond to different source channels and the different rows of the cost and prediction matrix correspond to different target channels, or vice versa.

9. The method of claim 1, wherein determining the inter-channel coding graph comprises determining a $p^{th}$ order graph from the basic graph which makes use of one or more predictors of order p between the channels of the multi-channel audio signal, such that the $p^{th}$ order graph comprises for each channel at maximum p directed edges pointing to this channel; with p being an integer, with $p \geq 1$; and determining, for a particular target channel which is encoded using a predictor of order p, a predictor of order p+1, which leads to a reduced cost for encoding the particular target channel compared to a cost of the predictor of order p, and which leads to an acyclic inter-channel coding graph, wherein determining the inter-channel coding graph comprises determining whether the predictor of order p+1 leads to a $p+1^{th}$ order graph comprising zero, one or more cycles;

if the $p+1^{th}$ order graph comprises zero cycles, determining the inter-channel coding graph based on the $p+1^{th}$ order graph;

if the $p+1^{th}$ order graph comprises a single cycle, adjusting the $p+1^{th}$ order graph to remove the single cycle, and determining the inter-channel coding graph based on the adjusted graph; and if the $p+1^{th}$ order graph comprises more than one cycle, replacing the predictor of order p+1 by the predictor of order p to determine a fallback graph, and determining the inter-channel coding graph based on the fallback graph, wherein adjusting the $p+1^{th}$ order graph to remove the single cycle comprises, determining a subgraph from the $p+1^{th}$ order graph comprising the single cycle;

determining a directed spanning tree for the subgraph; and replacing the subgraph by the directed spanning tree within the $p+1^{th}$ order graph to provide the adjusted graph.

10. The method of claim 9, wherein determining the inter-channel coding graph comprises determining a predictor of order p+1 for each target node which is encoded using a predictor of order p; and determining a cost benefit achieved by using a predictor of order p+1 for each target node which is encoded using a predictor of order p;

determining the particular target channels as the target channel having the highest cost benefit.

11. The method of claim 9, wherein determining a predictor of order p+1 for a target channel comprises determining a set of p+1 source channels and a set of p+1 prediction coefficients such that a linear combination of the channel signals of the p+1 source channels weighted by the p+1 prediction coefficients approximates the channel signals of the target channel;

a predictor of order p+1 for a target channel is determined by reducing, notably by minimizing, the cost for coding the residual signal of the target channel, wherein the method comprises determining pre-flattened channel signals for the channel signals of the N channels, respectively;

the cost for encoding the residual signal of a target channel predicted from a source channel is determined based on the pre-flattened channel signals of the target channel and of the source channel;

the basic graph and the inter-channel coding graph are determined based on the pre-flattened channel signals; and a prediction coefficient for predicting a target channel from a source channels is determined based on the pre-flattened channel signals of the target channel and of the source channel.

12. The method of claim 1, wherein the method comprises sorting the channels of the inter-channel coding graph to provide a topologically sorted graph, such that the channels are assigned to a sequence of positions;

a channel assigned to a first position from the sequence of positions can be encoded independently; and for each subsequent position from the sequence of positions, a channel assigned to this position can be encoded independently or can be predicted from the one or more channels assigned to one or more previous positions, wherein the method comprises encoding the topologically sorted graph and the multi-channel audio signal into a bitstream, such that a decoder is enabled to decode the channels of the multi-channel audio signal in accordance to the positions assigned to the channels.

13. The method of claim 1, wherein the basic graph is determined such that the basic graph comprises a dummy node, notably to avoid a directed edge from a node to itself;

a directed edge from the dummy node to a particular target channel is indicative of an independent encoding of the particular target channel;

the cost associated with the directed edge from the dummy node to the particular target channel corresponds to a direct cost for encoding the particular target channel independently; and the inter-channel coding graph is determined such that the dummy node corresponds to a root node of the inter-channel coding graph.

14. An audio encoder comprising a processor configured to perform the method of claim 1.

15. A method for encoding an inter-channel coding graph which is indicative of inter-channel coding of channels of a multi-channel audio signal into a bitstream; wherein the inter-channel coding graph comprises nodes that represent the channels of the multi-channel audio signal and directed edges that represent coding dependencies between the channels; wherein the method comprises, sorting the channels of the inter-channel coding graph to provide a topologically sorted graph, such that the channels are assigned to a sequence of positions;

a channel assigned to a first position from the sequence of positions can be encoded independently; and for each subsequent position from the sequence of positions, a channel assigned to this position can be encoded independently or can be encoded in dependence of one or more channels assigned to one or more previous positions;

encoding at least one of the topologically sorted graph and the multi-channel audio signal into a bitstream, such that a decoder is enabled to decode the channels of the multi-channel audio signal in accordance to the positions assigned to the channels.

16. The method claim 15, wherein the inter-channel coding graph is determined such that the inter-channel coding graph is a directed spanning tree, notably a minimum directed spanning tree, of the basic graph.

17. The method claim 15, wherein the method comprises converting a set of channel signals for the N channels into a set of inter-channel encoded signals using the inter-channel coding graph;

the set of inter-channel encoded signals comprises at least one channel signal and zero, one or more residual signals; and performing intra-channel encoding for each of the inter-channel encoded signals from the set of inter-channel encoded signals.

18. An audio encoder comprising a processor configured to perform the method of claim 15.

19. A method for performing inter-channel encoding of one or more dependent audio channels of a dependent presentation in dependence of a main audio channel of a main presentation; wherein the method comprises, determining a basic graph comprising the one or more dependent channels and the main channel as nodes and comprising directed edges between at least some of the channels; wherein a directed edge between a source channel and a target channel indicates that the channel signal of the target channel is predicted from the channel signal of the source channel, thereby leading to a residual signal for the target channel as a prediction residual; wherein a directed edge indicates a cost associated with coding the residual signal of the target channel; wherein the basic graph comprises one or more directed edges having the main channel as a source channel; and wherein the basic graph does not comprise any directed edges having the main channel as a target channel; and determining an inter-channel coding graph for the dependent presentation from the basic graph, such that the inter-channel coding graph is a directed acyclic graph; and applying the inter-channel coding graph for inter-channel encoding of at least one dependent audio channel.

20. An audio encoder comprising a processor configured to perform the method of claim 19.

* * * * *